US009341967B2

(12) United States Patent
Tsujino et al.

(10) Patent No.: US 9,341,967 B2
(45) Date of Patent: May 17, 2016

(54) METHOD FOR PRODUCING TONER PARTICLES

(71) Applicant: CANON KABUSHIKI KAISHA, Tokyo (JP)

(72) Inventors: Takeshi Tsujino, Mishima (JP); Kentaro Yamawaki, Mishima (JP); Junya Asaoka, Mishima (JP); Motoya Fukushima, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/582,949

(22) Filed: Dec. 24, 2014

(65) Prior Publication Data

US 2015/0185645 A1 Jul. 2, 2015

(30) Foreign Application Priority Data

Dec. 27, 2013 (JP) ..... 2013-271774

(51) Int. Cl.
*G03G 9/08* (2006.01)

(52) U.S. Cl.
CPC ..... *G03G 9/0806* (2013.01)

(58) Field of Classification Search
CPC . G03G 9/0804; G03G 9/0806; G03G 9/0808; G03G 9/081
See application file for complete search history.

(56) References Cited

U.S. PATENT DOCUMENTS 5,264,315 A * 11/1993 Tan ..... B01J 19/1862 430/110.2
6,309,788 B1 10/2001 Tsuji et al.
6,953,648 B2 10/2005 Tsujino et al.
7,252,917 B2 8/2007 Ohno et al.
7,323,282 B2 1/2008 Ohno et al.
7,494,758 B2 2/2009 Tsujino et al.
8,545,133 B2 10/2013 Fumita et al.
2007/0020553 A1* 1/2007 Marcello ..... C08F 6/18 430/137.14
2007/0243485 A1* 10/2007 Kurokawa ..... G03G 9/0806 430/270.1
2015/0004535 A1 1/2015 Yamawaki et al.

FOREIGN PATENT DOCUMENTS

JP 5-287564 A 11/1993
JP 10-153878 A 6/1998
JP 2003-287928 A 10/2003
JP 2006-160960 A 6/2006
JP 2012-93555 A 5/2012
JP 2012-93658 A 5/2012

* cited by examiner

*Primary Examiner* — Hoa V Le
(74) *Attorney, Agent, or Firm* — Fitzpatrick, Cella, Harper and Scinto

(57) ABSTRACT

A method for producing toner particles by a suspension polymerization method or a dissolution suspension method comprising: applying an inorganic dispersion stabilizer-containing liquid (liquid A) to a part that can come into contact with a polymerizable monomer composition or toner particle composition, the part being on an inner wall of a vessel used in a polymerization step or a vessel used in a solvent removal step; after the application of the liquid A, carrying out the polymerization step or solvent removal step; discharging the contents of the vessel after the completion of this polymerization step or solvent removal step; and after the contents of the vessel have been discharged, bringing an acidic aqueous solution (liquid B) to dissolve the inorganic dispersion stabilizer into contact with the inner wall of the vessel.

8 Claims, 1 Drawing Sheet

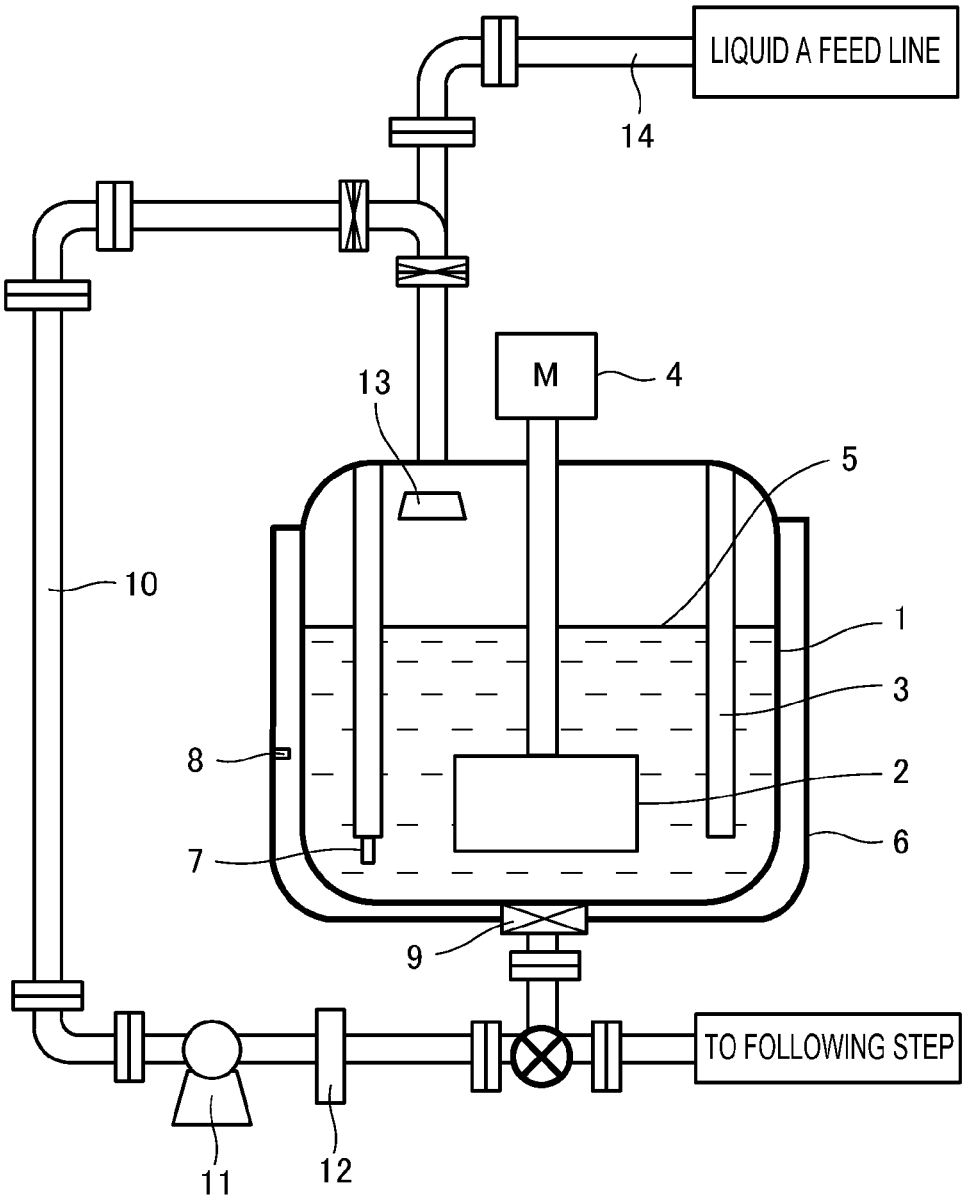
LIQUID A FEED LINE
14
M
4
13
5
10
1
3
8
2
7
6
9
TO FOLLOWING STEP
11
12

METHOD FOR PRODUCING TONER PARTICLES

BACKGROUND OF THE INVENTION

1. Field of the Invention

The present invention relates to a method for producing toner particles that are used for electrostatic image development in image-forming methods such as electrophotography, electrostatic printing, and magnetic recording. More particularly, the present invention relates to a toner particle production method that, during toner particle production by a wet method, prevents scale from attaching to, for example, the inner walls of the vessel used in the polymerization step and the inner walls of the vessel used in the solvent removal step.

2. Description of the Related Art

Within the sphere of toner particle production methods, for example, the suspension polymerization method and emulsion polymerization and aggregation method, which use a polymerizable monomer and so forth, and the dissolution suspension method, in which a binder resin and so forth is granulated in a solvent, have been actively introduced in recent years for wet-method toners.

For example, in the suspension polymerization method, a polymerizable monomer and a colorant and optionally a release agent, polymerization initiator, crosslinking agent, charge control agent, and other additives are uniformly dissolved or dispersed to prepare a polymerizable monomer composition. This is dispersed, using a suitable stirrer, in an aqueous medium that contains a dispersion stabilizer and the polymerizable monomer is then polymerized to obtain a suspension of toner particles having a desired particle diameter.

In toner production by this suspension polymerization method, the polymerization step is ordinarily carried out using a polymerization vessel that is provided with a stirring means and a heating/cooling means. Scale deposits are formed when during polymerization the polymer composition sticks to, e.g., the inner walls of the vessel, the surfaces of the stirring means, and the baffles, and polymerization occurs in these locations. These scale deposits remain within the polymerization vessel even after the completion of the polymerization step. When these deposits are left in place, they increase in amount in correspondence to the number of consecutive polymerization step batches and lower the heat transfer performance of the polymerization vessel and exercise a negative effect on the stability of the polymerization reaction. In addition, the time required to raise the polymerization temperature and the time required for cooling after the completion of polymerization are increased as the scale deposits grow, resulting in a substantial decline in the productivity. The jacket area ratio with respect to the vessel volume declines in association with an increase in the scale, and as a result the influence of the decline in heat transfer performance also increases as the scale increases. Due to this, the problems of (1) a reduced stability for the polymerization reaction and (2) the increase in the time required for temperature ramp up and cooling are made worse as the scale increases and as a consequence are critical issues with respect to process scale up. Moreover, when the scale deposits exfoliates and fall off and become admixed into the toner product, they are observed as coarse, amorphous particles. When these coarse, amorphous particles take on a large proportion in the toner, this has a negative effect on toner properties, e.g., the triboelectric charging behavior, and on the developing characteristics when image evaluation is performed, causing a decline in product properties, e.g., the appearance of image density variations, white streaks, and fogging is seen, and thus being undesirable.

When these scale deposits exfoliate/fall off after having grown to sufficient size, they cause clogging and sticking in the conduits and valves connected to the polymerization vessel. This then necessitates frequent removal of the deposits, causing a lowering of the availability factor for the production apparatus.

In the dissolution suspension method, which is a different production method from the suspension polymerization method described in the preceding, a toner particle composition is obtained by dispersing or dissolving a toner particle composition, e.g., of a binder resin and colorant and optionally a release agent and other additives, in a volatile solvent, for example, a low-boiling organic solvent. The toner particle composition is then granulated in a dispersing agent-containing aqueous medium and converted into liquid droplets, followed by removal of the volatile solvent. Just as in the polymerization step in the suspension polymerization method described in the preceding, the growth of scale deposits of the toner particle composition occurs on the vessel inner wall in the solvent removal step in the dissolution suspension method, which causes a deterioration in the thermal conduction performance of the vessel and a substantial reduction in the productivity.

With regard to methods for preventing this scale attachment, for example, a method is proposed in Japanese Patent Application Laid-open No. H5-287564 in which an anti-scaling coating is formed on the vessel inner wall by forming an inorganic dispersed powder layer on a layer of an adhesive inorganic compound provided by mixing colloidal silica and an alkyl silicate.

A method is disclosed in Japanese Patent Application Laid-open No. 2006-160960 that prevents the attachment of a polymer scale through the application to the vessel inner wall of an anti-scaling agent that contains a vinylphenol-type polymer and the condensation reaction product of an aldehyde compound and a hydroxynaphthalene-type compound.

With regard to methods of preventing scaling in the gas phase region and gas/liquid interface within a vessel, a method is introduced in Japanese Patent Application Laid-open No. H10-153878 in which water or a dispersion stabilizer-containing aqueous dispersion medium is sprayed during polymerization on the inner wall in the gas phase region in the polymerization vessel.

An anti-scaling method is disclosed in Japanese Patent Application Laid-open No. 2003-287928 in which a dispersion stabilizer-containing aqueous dispersion medium is sprayed on the vessel inner walls at the same time that a preparation is introduced into the vessel, this preparation being obtained by mixing a separately prepared dispersion stabilizer-containing aqueous dispersion medium with a dispersion of the polymerizable monomer composition.

The focus for inhibiting attachment in the means disclosed in Japanese Patent Application Laid-open Nos. H5-287564, 2006-160960, H10-153878, and 2003-287928 rests mainly on increasing the repulsion between the dispersed droplets of the polymerizable monomer and an inorganic dispersed powder or an anti-scaling agent. However, the attachment-inhibiting effect provided by these methods is not adequate and a satisfactory anti-scaling effect is not obtained. In investigations carried out by the applicant, a satisfactory anti-scaling effect was not obtained using these methods, and in particular during continuous production the attachment-inhibiting effect is maintained only for several batches.

Japanese Patent Application Laid-open Nos. 2012-93555 and 2012-93658, on the other hand, introduce several methods for efficiently removing scale deposits once they have been produced. For example, methods in which a removal agent, e.g., an organic solvent or aqueous base solution, is sprayed into the polymerization vessel or is filled into the polymerization vessel and heating and stirring are used in combination therewith are convenient and common. However, with all of these methods, the focus is how well the scale deposits are dissolved or swollen in a solution, and even with heating an extended period of time is required to a certain degree in order to completely remove the deposits.

SUMMARY OF THE INVENTION

The present invention provides a toner particle production method that solves the problems identified above. That is, for toner particle production methods that proceed via a suspension polymerization method or a dissolution suspension method, the present invention provides a toner particle production method that can suppress the production of scale deposits on the vessel inner walls in the polymerization step of polymerizing dispersed droplets of the polymerizable monomer composition or in the solvent removal step of removing the solvent from the dispersed droplets of the toner particle composition, and that enables facile removal of scale deposits that have been produced.

The present inventors discovered the following method as a result of intensive investigations into inhibiting the production of the polymer scale in the polymerization step or the toner composition scale in the solvent removal step, and into the removal thereof.

The present invention is a method for producing toner particles comprising the steps of:

(1) providing an aqueous dispersion in which particles are dispersed in an aqueous medium, the particles containing (i) a polymerizable monomer and a colorant, or (ii) a mixed solution in which a toner particle composition comprising a binder resin and a colorant, and an organic solvent, are contained, the toner particle composition being dissolved or dispersed in the organic solvent, (2) introducing the aqueous dispersion into a vessel, and (3) obtaining the toner particles by (i) polymerizing the polymerizable monomer in the particles, or (ii) removing the organic solvent from the mixed solution in the particles, (4) removing a content in the vessel after the step (3), wherein, the method further comprises a step of applying an inorganic dispersion stabilizer containing liquid (liquid A) and attaching the inorganic dispersion stabilizer to a part of an inner wall of the vessel, prior to introducing the aqueous dispersion into the vessel in the step (2), the part of the inner wall of the vessel including a portion where the aqueous dispersion which is to be introduced in the step (2) is come into contact with, and a step of removing the inorganic dispersion stabilizer attached to the part of the inner wall of the vessel by using an acidic aqueous solution (liquid B) after the step (4).

In accordance with the present invention, the admixture into the product toner of coarse, amorphous particles originating with the scale deposits can be prevented through a suppression—in the polymerization step in toner particle production by the suspension polymerization method and in the solvent removal step in toner particle production by the dissolution suspension method—of the production of polymer scale or toner composition scale produced within the vessel, and by enabling facile removal even when the scale has been produced. Moreover, toner particles with a stable quality are obtained due to an inhibition of the variations in temperature control that are caused by an impaired heat conduction due to accumulated polymer deposits. In addition, the productivity is improved due to a suppression of the reduction in the efficiency of cooling and ramp up of the temperature within the vessel that is associated with the reduction in thermal conductivity cause by the accumulated polymer deposits. The productivity is also improved because frequent removal of the polymer deposits is rendered substantially unnecessary since, for example, pipe clogging due to the exfoliation of the polymer deposits no longer occurs.

Further features of the present invention will become apparent from the following description of exemplary embodiments (with reference to the attached drawings).

BRIEF DESCRIPTION OF THE DRAWINGS

FIG. 1 is a cross-sectional diagram of a preferred vessel for the present invention for use in the polymerization step or solvent removal step.

DESCRIPTION OF THE EMBODIMENTS

The present invention is favorably used for toner particle production methods that use the suspension polymerization method, which uses a polymerizable monomer and so forth, or that use the dissolution suspension method, in which a binder resin and so forth is granulated in a solvent. In the following, the present invention is described using a toner particle production method based on the suspension polymerization method as an example.

The suspension polymerization method is a production method that obtains toner particles by adding, to an aqueous medium, a polymerizable monomer composition that contains at least a polymerizable monomer and a colorant; granulating the polymerizable monomer composition in the aqueous medium to form particles of the polymerizable monomer composition; and polymerizing the polymerizable monomer present in the particles of the polymerizable monomer composition.

<The Step of Producing the Polymerizable Monomer Composition>

A polymerizable monomer composition is prepared that contains at least a polymerizable monomer and a colorant. The colorant may be mixed with another composition after preliminary dispersion in the polymerizable monomer using, for example, a stirred media mill, or dispersion may be carried out after the entire composition has been mixed.

<The Granulating Step>

The polymerizable monomer composition is introduced into an inorganic dispersion stabilizer-containing aqueous medium and granulation is performed by effecting dispersion to form particles of the polymerizable monomer composition in the aqueous medium and thereby obtain a dispersion in which particles of the polymerizable monomer composition are dispersed. The granulating step can be carried out in, for example, a vertical stirred tank equipped with a high shear force stirrer. Commercial high shear force stirrers can be used here, for example, High Shear Mixer (by IKA), the T. K. Homomixer (Tokushu Kika Kogyo Co., Ltd.), the T. K. FILMICS (Tokushu Kika Kogyo Co., Ltd.), and the Clearmix (M Technique Co., Ltd.).

The inorganic dispersion stabilizer can be exemplified by carbonates such as barium carbonate, calcium carbonate, and magnesium carbonate; metal phosphates such as aluminum phosphate, magnesium phosphate, calcium phosphate, barium phosphate, and zinc phosphate; sulfates such as barium sulfate and calcium sulfate; and metal hydroxides such as calcium hydroxide, aluminum hydroxide, magnesium hydroxide, and ferric hydroxide. A single one of these may be used or a combination of two or more may be used. These develop their dispersion stabilizer function by their presence as microparticles in the aqueous medium.

<The Polymerization Step>

A dispersion of finely divided polymer particles is obtained by the polymerization of the polymerizable monomer in the dispersion of polymerizable monomer composition particles yielded by the granulating step. An ordinary polymerization vessel having a stirring means and capable of temperature control can be used in the polymerization step in the present invention.

The polymerization temperature is at least 40° C., and the polymerization step is generally run at 50 to 90° C. The polymerization temperature may be constant from beginning to end, but may also be raised in the latter half of the polymerization step with the goal of obtaining a desired molecular weight distribution. The stirring means used with the polymerization vessel may be any stirring means capable of maintaining a uniform temperature within the vessel and capable of suspending the dispersed polymerizable monomer composition without stagnation. Stirring blades are favorable as the stirring means and can be exemplified by the usual stirring blades, e.g., paddle blades, pitched paddle blades, three-wing backswept blades, propeller blades, disk turbine blades, helical ribbon blades, and anchor blades, as well as by FULLZONE (Shinko Pantec Co., Ltd.), Twinstir (Shinko Pantec Co., Ltd.), Maxblend (Sumitomo Heavy Industries, Ltd.), Super-Mix (Satake Chemical Equipment Mfg., Ltd.), and Hi-F Mixer (Soken Chemical & Engineering Co., Ltd.).

Without intending to be limited thereto, an example of a cross-sectional diagram of a polymerization vessel suitable for use in the present invention is given in FIG. 1.

The volume of the vessel used by the present invention is preferably 1,000 to 30,000 L and is more preferably 5,000 to 20,000 L. The effect of suppressing a reduction in productivity through an inhibition of scale deposition is readily obtained for this range.

In FIG. 1, 1 is a vessel; 2 is a stirring blade; 3 is a baffle; 4 is a stirring motor; 5 is a gas/liquid interface; 6 is a temperature control jacket; 7 is a polymerization vessel internal thermometer; 8 is a jacket thermometer; 9 is a vessel discharge valve; 10 is a circulation line; 11 is a circulation pump; 12 is a strainer; 13 is a shower nozzle; and 14 is a liquid A feed line.

<The Liquid A Application Step>

When the present invention is used in toner particle production by the suspension polymerization method, prior to the execution of the polymerization step the inner wall of the vessel 1 is coated with an inorganic dispersion stabilizer by applying an inorganic dispersion stabilizer-containing liquid (liquid A) and attaching the inorganic dispersion stabilizer to the inner wall of the vessel 1. Liquid A is applied to a part of the vessel inner wall (interior) that can come into contact with the aqueous dispersion containing the polymerizable monomer composition (or the toner particle composition in the dissolution suspension method). Application over the entire vessel interior is more preferred.

Any method capable of providing a uniform application may be taken up as the method of applying the liquid A to the inner wall of the vessel 1, and examples here are spraying methods that use a shower nozzle or spray nozzle, methods in which the vessel interior is filled with liquid A followed by its discharge, and painting methods using a brush and so forth. In an example of a method for efficiently applying a small amount of the inorganic dispersion stabilizer-containing liquid (liquid A), liquid A resident at the vessel bottom is passed through the vessel discharge valve 9 and circulation line 10 and is re-broadcast into the interior of the vessel 1. That is, the vessel is preferably provided with a circulation line that discharges the liquid A (or the liquid B) from the vessel bottom and conveys it again into the vessel interior from the upper portion of the vessel. The presence of a circulation line functions to keep down the amount of use of the starting materials for the liquid A (or the liquid B) and is thus efficient and economical.

The time of contact by the liquid A with the vessel inner wall during application of the liquid A is generally 3 to 30 minutes and is preferably 5 to 15 minutes. The vessel temperature during contact of the liquid A with the vessel inner wall is generally 40 to 90° C. and is preferably 50 to 80° C.

The application of the liquid A is preferably followed by a drying step in which it is dried. This serves to increase the adherence of the inorganic dispersion stabilizer to the inner wall of the vessel 1. There are no particular limitations on the drying method, but when a temperature control jacket is present as in the apparatus shown in FIG. 1, drying may be effectively carried out by heating the inner wall of the vessel 1 using this jacket 6. The drying time is generally 10 to 120 minutes and is preferably 20 to 90 minutes. The drying temperature is generally 40 to 90° C. and is preferably 50 to 80° C.

After the liquid A has been applied, the dispersion provided by the granulating step and having particles of the polymerizable monomer composition dispersed therein, is introduced into the vessel 1 which has been thoroughly coated with the inorganic dispersion stabilizer, and the polymerization step is carried out. The attachment of polymer scale to the inner walls of the vessel 1 can then be inhibited by the repulsion between the inorganic dispersion stabilizer on the inner wall surfaces of the vessel 1 and the inorganic dispersion stabilizer that coats the droplets of the polymerizable monomer composition. Moreover, scale attachment to the surfaces of the accessory equipment in the vessel can also be inhibited by also performing the same treatment on the surfaces of the accessory equipment, e.g., the stirring blade 2, baffle 3, and so forth.

The liquid component in the liquid A should be volatile and should not dissolve the inorganic dispersion stabilizer, and, for example, water or an alcohol such as methanol, ethanol, 1-propanol, 2-propanol, 1-butanol, 2-butanol, isobutyl alcohol, or tert-butyl alcohol can be used. Other examples are organic solvents such as acetone, methyl acetate, ethyl acetate, dimethyl sulfoxide, n-hexane, toluene, and xylene. A single one of these may be used or two or more may be used in combination. Among these examples, the use of water by itself or a water+alcohol combination is favorable from an industrial and economic standpoint.

The inorganic dispersion stabilizer present in the liquid A can be exemplified by carbonates such as barium carbonate, calcium carbonate, and magnesium carbonate; metal phosphates such as aluminum phosphate, magnesium phosphate, calcium phosphate, barium phosphate, and zinc phosphate; sulfates such as barium sulfate and calcium sulfate; and metal hydroxides such as calcium hydroxide, aluminum hydroxide, magnesium hydroxide, and ferric hydroxide. Sparingly water-soluble metal compounds are more favorably used among these inorganic dispersion stabilizers. Moreover, within this set, inorganic dispersion stabilizers are preferred that are sparingly water soluble with respect to water and readily soluble with respect to acidic solutions of, e.g., hydrochloric acid or sulfuric acid. Sparingly water soluble with respect to water refers to a solubility of not more than 0.20 g in 100 g of RO water at 25° C. Specifically, sparingly water-soluble metal phosphates such as aluminum phosphate, magnesium phosphate, calcium phosphate, barium phosphate, and zinc phosphate; sparingly water-soluble metal hydroxides such as calcium hydroxide, aluminum hydroxide, magnesium hydroxide, and ferric hydroxide; and sparingly water-soluble carbonates such as barium carbonate, calcium carbonate, and magnesium carbonate are preferably used. A single one of these inorganic dispersion stabilizers may be used or two or more may be used in combination.

The content of the inorganic dispersion stabilizer in 100 mass parts of the liquid A is generally 2 to 20 mass parts and is preferably 3 to 15 mass parts.

The inorganic dispersion stabilizer present in the aqueous medium in the granulating step and the inorganic dispersion stabilizer present in liquid A may each have different compositions or may have the same composition. When inorganic dispersion stabilizers with different compositions are used, the inorganic dispersion stabilizer present in liquid A is preferably an inorganic dispersion stabilizer with a composition that is less soluble in the pH region of the aqueous medium in granulation than is the inorganic dispersion stabilizer present in the aqueous medium during granulation. When such a combination is used, the electrostatic repellent force from the inorganic dispersion stabilizer already coated on the inner wall of the vessel 1 will be sufficiently effective even when the dispersion of the polymerizable monomer composition is transported into the interior of the vessel 1 after the preparation in the granulating step of the dispersion in which the particles of a desired polymerizable monomer composition are dispersed, and as a consequence scaling can be effectively suppressed.

In addition, the liquid A is preferably prepared in the interior of the vessel. By preparing the liquid A in the interior of the polymerization vessel, the coarsening of the particle size caused by aggregation due to changes with elapsed time is less than for commercial inorganic dispersion stabilizers, and as a consequence a stable and uniform coating is made possible and the scale attachment inhibiting effect is thereby increased.

<The Step of Removing the Inorganic Dispersion Stabilizer by Using the Liquid B>

After the completion of the polymerization step, the contents of the vessel 1 (the toner particle dispersion) are discharged and the inner walls of the vessel 1 are brought into contact with an acidic aqueous solution (liquid B) to dissolve the inorganic dispersion stabilizer in the liquid A, that was applied to the inner walls of the vessel 1 in the liquid A application step.

A solution capable of dissolving the inorganic dispersion stabilizer can be used as an acidic aqueous solution. Here, "capable of dissolving the inorganic dispersion stabilizer" indicates that no dissolution residue is present when 0.50 g of the inorganic dispersion stabilizer is added to 100 g of RO water at 25° C., and, after adjusting to the desired pH by the addition of an acidic aqueous solution while stirring, stirring is then continued for 3 minutes.

Scale deposits can be completely removed by washing by contact with the liquid B. In the scale removal method in the present invention, removal of the scale deposits and inorganic dispersion stabilizer is made possible by the dissolution by liquid B of the inorganic dispersion stabilizer that was previously applied to the inner walls of the vessel 1. Since the inorganic dispersion stabilizer that was previously applied to the inner walls of the vessel 1 is also thoroughly removed by the liquid B, the surface of the vessel 1 can be returned to the same level as its condition before the polymerization.

With regard to the frequency of execution of the present invention, preferably a single batch or two batches of the polymerization step (or solvent removal step) are carried out after the application of the liquid A, followed by contact with the liquid B and then application of the inorganic dispersion stabilizer in the liquid A to the inner walls of the vessel 1 prior to the next polymerization step. When the batch interval is extended beyond this, scale deposits will then readily grow thickly over the entire surface of the inner wall of the vessel 1, and as a consequence it may not be possible for the liquid B to thoroughly dissolve the inorganic dispersion stabilizer that was applied to the inner wall of the vessel 1. As a result, scale deposits may end up remaining on the surface of the vessel 1 and the scale deposits may then tend to increase in proportion to the number of batches.

Any method may also be taken up as the method for effecting contact with the liquid B, for example, a method in which broadcasting is performed with a spray nozzle or shower nozzle, or a method in which the polymerization vessel is filled with the liquid B. However, for a vessel 1 as shown in FIG. 1, a method preferred in terms of the dissolvability of the inorganic dispersion stabilizer is to fill the vessel 1 with the liquid B followed by stirring. A method in which liquid B resident at the vessel bottom is passed from the vessel discharge valve 9 through the circulation line 10 and is rebroadcast into the interior of the vessel is an example of means for implementing such a method, considering the takt time and economics, for efficiently broadcasting a small amount of the liquid B within the vessel 1 and dissolving the inorganic dispersion stabilizer at the surface of the vessel 1. When this is done, the washability is increased even further by heating the liquid B. The heating temperature for the liquid B is generally from at least 40° C. to not more than 80° C. Some effects are obtained at above normal temperature, and the effects become even more substantial at from at least 50° C. to not more than 100° C.

The time of contact by the liquid B with the vessel inner wall is generally 3 to 90 minutes and is preferably 5 to 60 minutes.

The acidic range of from at least 0.3 to not more than 6.0 is preferred for the pH of the liquid B. For example, hydrochloric acid, sulfuric acid, nitric acid, or carbonic acid can be used in the liquid B. The solvent in the liquid B is preferably water. A solvent provided by the addition of an alcohol to water may also be used depending on the circumstances. There is no dissolution of the glass-lined vessel surface that is preferably used in the present invention, even in the high-temperature region up to about 120° C., when the pH of the liquid B is in the acidic range of equal to or less than 6.0, and hence this is preferred. A pH for the liquid B in the alkaline range is disfavored because there is a risk of gradual dissolution of the glass-lined vessel surface at a pH equal to or greater than 9.0, although this also depends on the pH and temperature.

When a sparingly water-soluble metal phosphate is used for the inorganic dispersion stabilizer in the liquid A, the pH of a liquid B capable of dissolving the sparingly water-soluble metal phosphate is preferably equal to or less than 3.0. When the pH exceeds 3.0, a thorough dissolution of the sparingly water-soluble metal phosphate may not occur and removal of the polymer scale will tend to be inadequate.

When a sparingly water-soluble metal hydroxide is used for the inorganic dispersion stabilizer in the liquid A, the pH of a liquid B capable of dissolving the sparingly water-soluble metal hydroxide is preferably equal to or less than 5.5. When the pH exceeds 5.5, a thorough dissolution of the sparingly water-soluble metal hydroxide may not occur and removal of the polymer scale will tend to be inadequate.

At least the bottom portion of the vessel is preferably subjected to a glass lining treatment. More preferably the liquid contact portions of the, e.g., vessel inner wall surfaces, stirring blades, baffles, and so forth, are subjected to a glass lining treatment. The entire interior of the vessel is particularly preferably subjected to a glass lining treatment. This is because the adherence is strengthened by the generation of a structural electrical interaction between the inorganic dispersion stabilizer in the liquid A and the silicon present at the surface of the glass lining.

The glass lining treatment method is a method in which glass in a prescribed thickness is formed by repeatedly stacking glass particles in layer form on the surface of the metal that is the vessel material and firing. The thickness of the glass is preferably 0.6 mm to 1.5 mm. Commercial glass-lined vessels can be used, for example, from Kobelco Eco-Solutions Co., Ltd. or Ikebukuro Horo Kogyo Co., Ltd.

<The Distillation Step>

In order as necessary to remove volatile impurities, e.g., secondary products and unreacted polymerizable monomer, a portion of the aqueous medium may be distillatively removed in a distillation step after the completion of the polymerization. This distillation step may be run at normal pressure or under reduced pressure.

<The Washing Step, Solid-Liquid Separation Step, and Drying Step>

The polymer particle dispersion may also be treated with an acid or alkali for the purpose of removing dispersion stabilizer attached to the polymer particle surface. After this, the polymer particles are separated from the liquid phase by an ordinary solid-liquid separation method, and, in order to completely remove the acid or alkali and dispersion stabilizer component dissolved therein, the polymer particles are washed using another addition of water. This washing step is repeated several times, and, once a thorough washing has been achieved, solid-liquid separation is then carried out once again to obtain the toner particles. As necessary, the obtained toner particles are dried by a known drying means.

<The Classification Step>

The thusly obtained toner particles have a distinctly sharper particle size distribution than conventional pulverization method toners, but when an even sharper particle size distribution is required, the particles outside the desired particle size distribution may also be fractionated and removed by carrying out classification with, for example, an air classifier.

An example of the use of the present invention in toner particle production by a dissolution suspension method is described in the following. The dissolution suspension method is a toner particle production method that includes a granulating step of dispersing, in an aqueous medium, a mixed solution provided by dissolving or dispersing, in an organic solvent, a toner particle composition containing a binder resin and a colorant, and forming particles of the mixed solution; and a solvent removal step of obtaining toner particles by removing the organic solvent present in the particles of this mixed solution.

<The Step of Preparing the Mixed Solution>

The gradual addition of, e.g., the binder resin, colorant, and so forth, to the organic solvent while stirring to effect dissolution or dispersion may be used for the method for preparing the mixed solution in which a toner particle composition of, e.g., the binder resin, colorant, and so forth, is dissolved or dispersed in an organic solvent. However, when a pigment is used for the colorant, or when an addition that is poorly soluble in the organic solvent, e.g., release agent or charge control agent, is made, preferably the particles have been made small prior to addition to the organic solvent. A know dispersing device, such as a bead mill or disk mill, can be used for dispersion.

<The Granulating Step>

A dispersion of the toner particle composition is prepared by dispersing the mixed solution provided by the preceding step in an aqueous medium that contains at least a surfactant or an inorganic dispersion stabilizer. When a modified resin having a segment reactive with an active hydrogen group-containing compound has been added to the toner particle composition, the active hydrogen group-containing compound may be added and the toner particle composition dispersion may then be formed in the aqueous medium while producing the binder resin by the reaction of the active hydrogen group-containing compound with the modified resin. The apparatus used in the granulating step can be, for example, a vertical stirred tank equipped with a high shear force stirrer, as in the previously described suspension polymerization method. Commercial high shear force stirrers can be used here, for example, the High Shear Mixer from IKA, the T. K. Homomixer (Tokushu Kika Kogyo Co., Ltd.), the T. K. FILMICS (Tokushu Kika Kogyo Co., Ltd.), and the Clearmix (M Technique Co., Ltd.).

The surfactant can be exemplified by anionic surfactants such as alkylbenzenesulfonate salts, α-olefinsulfonate salts, and phosphate esters; cationic surfactants such as amine salt types, e.g., alkylamine salts, aminoalcohol fatty acid derivatives, polyamine fatty acid derivatives, and imidazoline, and quaternary ammonium salt types such as alkyltrimethylammonium salts, dialkyldimethylammonium salts, alkyldimethylbenzylammonium salts, pyridinium salts, alkylisoquinolinium salts, and benzethonium chloride; nonionic surfactants such as fatty acid amide derivatives and polyhydric alcohol derivatives; and amphoteric surfactants such as alanine, dodecyldi(aminoethyl)glycine, di(octylaminoethyl) glycine, and N-alkyl-N,N-dimethylammonium betaine. A single one of these may be used or a combination of two or more may be used.

The inorganic dispersion stabilizer used to produce the toner particles by the dissolution suspension method can be exemplified by the same inorganic dispersion stabilizers as for the suspension polymerization method. A single one of these may be used or a combination of two or more may be used.

<The Solvent Removal Step>

The organic solvent is removed in the solvent removal step from the resulting dispersion of the toner particle composition. A method may be used to remove the organic solvent in which the temperature is gradually raised while stirring the entire system in order to completely remove the organic solvent in the droplets by evaporation. Or, the organic solvent may be removed by evaporation by lowering the pressure while stirring the dispersion of the toner particle composition.

<The Maturation Step>

In those instances of the addition of a modified resin having a terminal segment capable of reacting with a compound containing an active hydrogen group, such as, e.g., the isocyanate group, a maturation step may be carried out in order to develop the chain extension and/or crosslinking reaction of the isocyanate. The maturation time is generally 10 minutes to 40 hours and is preferably 2 to 24 hours. The reaction temperature is generally 0 to 65° C. and is preferably 35 to 50° C.

An example of a cross-sectional diagram of a vessel favorably used in the present invention for the solvent removal step and maturation step is shown in FIG. 1, but this is not intended as a limitation thereto.

The solvent removal step and maturation step may be run in the same vessel or may be carried out in different vessels.

(The Washing Step, Solid-Liquid Separation Step, Drying Step, and Classification Step)

These steps may be carried out using the same processes as previously described for the suspension polymerization method.

<The Liquid A Application Step and the Liquid B Contact Step>

When the present invention is used in toner particle production by the dissolution suspension method, prior to the execution of the solvent removal step the inner wall of the vessel 1 is coated with an inorganic dispersion stabilizer by the application of an inorganic dispersion stabilizer-containing liquid (liquid A) to the surface of the inner wall of the vessel 1. The method for applying the inorganic dispersion stabilizer is the same as the means described above for the suspension polymerization method.

This is followed by delivery, into the vessel 1, of the toner particle composition dispersion prepared in the granulating step, and a solvent removal step and optionally a maturation step are carried out using the previously described conditions. After the completion of the solvent removal step (and maturation step), the toner particle composition dispersion in the vessel 1 is discharged and the scale deposits are removed by contacting the inner wall of the vessel 1 with an acidic aqueous liquid (liquid B) that can dissolve the inorganic dispersion stabilizer that was preliminarily applied to the vessel inner wall. The method and conditions in the liquid B contact step are the same as for the previously described means for the suspension polymerization method.

<The Polymerizable Monomer>

Radically polymerizable vinylic polymerizable monomers are polymerizable monomers preferred for use in the production method of the present invention. This vinylic polymerizable monomer may be a monofunctional vinylic polymerizable monomer or a polyfunctional vinylic polymerizable monomer. The monofunctional polymerizable monomer can be exemplified by the following: styrene; styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene; acrylic monomers such as methyl acrylate, ethyl acrylate, n-propyl acrylate, isopropyl acrylate, n-butyl acrylate, isobutyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxyethyl acrylate; methacrylic polymerizable monomers such as methyl methacrylate, ethyl methacrylate, n-propyl methacrylate, isopropyl methacrylate, n-butyl methacrylate, isobutyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate; vinyl esters such as methylene aliphatic monocarboxylic acid esters, vinyl acetate, vinyl propionate, vinyl butyrate, vinyl benzoate, and vinyl formate; vinyl ethers such as vinyl methyl ether, vinyl ethyl ether, and vinyl isobutyl ether; and vinyl ketones such as vinyl methyl ketone, vinyl hexyl ketone, and vinyl isopropyl ketone.

The polyfunctional polymerizable monomer can be exemplified by the following: diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxydiethoxy)phenyl)propane, trimethylolpropane triacrylate, tetramethylolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-(methacryloxydiethoxy)phenyl)propane, 2,2'-bis(4-(methacryloxypolyethoxy)phenyl)propane, trimethylolpropane trimethacrylate, tetramethylolmethane tetramethacrylate, divinylbenzene, divinylnaphthalene, and divinyl ether.

In the present invention, a single monofunctional polymerizable monomer or a combination of two or more may be used, or, a combination of monofunctional polymerizable monomer and polyfunctional polymerizable monomer may be used. Among these monomers, the use of styrene or a styrene derivative, either as a single selection or as a mixture of selections or as a mixture thereof with another monomer, is preferred from the standpoint of the durability and developing characteristics of the toner.

<The Colorant>

The following organic pigments and dyes and inorganic pigments are examples of colorants preferred for use in the present invention.

Copper phthalocyanine compounds and their derivatives, anthraquinone compounds, and basic dye lake compounds can be used for the organic pigments and organic dyes used as cyan colorants.

The following are specific examples: C. I. Pigment Blue 1, C. I. Pigment Blue 7, C. I. Pigment Blue 15, C. I. Pigment Blue 15:1, C. I. Pigment Blue 15:2, C. I. Pigment Blue 15:3, C. I. Pigment Blue 15:4, C. I. Pigment Blue 60, C. I. Pigment Blue 62, and C. I. Pigment Blue 66.

The organic pigments and organic dyes used as magenta colorants can be exemplified by the following: condensed azo compounds, diketopyrrolopyrrole compounds, anthraquinone compounds, quinacridone compounds, basic dye lake compounds, naphthol compounds, benzimidazolone compounds, thioindigo compounds, and perylene compounds.

Specific examples are as follows: C. I. Pigment Red 2, C. I. Pigment Red 3, C. I. Pigment Red 5, C. I. Pigment Red 6, C. I. Pigment Red 7, C. I. Pigment Violet 19, C. I. Pigment Red 23, C. I. Pigment Red 48:2, C. I. Pigment Red 48:3, C. I. Pigment Red 48:4, C. I. Pigment Red 57:1, C. I. Pigment Red 81:1, C. I. Pigment Red 122, C. I. Pigment Red 144, C. I. Pigment Red 146, C. I. Pigment Red 150, C. I. Pigment Red 166, C. I. Pigment Red 169, C. I. Pigment Red 177, C. I. Pigment Red 184, C. I. Pigment Red 185, C. I. Pigment Red 202, C. I. Pigment Red 206, C. I. Pigment Red 220, C. I. Pigment Red 221, and C. I. Pigment Red 254.

Compounds as typified by condensed azo compounds, isoindolinone compounds, anthraquinone compounds, azo metal complexes, methine compounds, and allylamide compounds are used as the organic pigments and organic dyes used as yellow colorants.

Specific examples are as follows: C. I. Pigment Yellow 12, C. I. Pigment Yellow 13, C. I. Pigment Yellow 14, C. I. Pigment Yellow 15, C. I. Pigment Yellow 17, C. I. Pigment Yellow 62, C. I. Pigment Yellow 74, C. I. Pigment Yellow 83, C. I. Pigment Yellow 93, C. I. Pigment Yellow 94, C. I. Pigment Yellow 95, C. I. Pigment Yellow 97, C. I. Pigment Yellow 109, C. I. Pigment Yellow 110, C. I. Pigment Yellow 111, C. I. Pigment Yellow 120, C. I. Pigment Yellow 127, C. I. Pigment Yellow 128, C. I. Pigment Yellow 129, C. I. Pigment Yellow 147, C. I. Pigment Yellow 151, C. I. Pigment Yellow 154, C. I. Pigment Yellow 155, C. I. Pigment Yellow 168, C. I. Pigment Yellow 174, C. I. Pigment Yellow 175, C. I. Pigment Yellow 176, C. I. Pigment Yellow 180, C. I. Pigment Yellow 181, C. I. Pigment Yellow 191, and C. I. Pigment Yellow 194.

Carbon black and black colorants provided by color mixing using the yellow/magenta/cyan colorants described above to give a black color, can be used as the black colorant.

These colorants can be used individually or in mixture and can be used in the form of a solid solution. The colorant used in the toner particles according to the present invention should be selected considering the hue angle, chroma, lightness, lightfastness, and OHP transparency and the dispersibility in the toner.

The colorant is preferably added at from at least 1 mass parts to not more than 20 mass parts per 100 mass parts of the polymerizable monomer or binder resin.

The colorant is preferably selected considering the polymerization inhibiting action that colorants have and their aqueous phase migration behavior. The dyes and carbon black are preferably subjected to a surface modification in advance, for example, to a hydrophobic treatment with a substance that does not inhibit polymerization. With regard to the method for treating the surface of a dye, for example, the polymerizable monomer may be polymerized in advance in the presence of the dye to obtain a colored polymer and the thusly obtained colored polymer may be added to the starting materials for the toner, e.g., the polymerizable monomer composition and so forth. With a carbon black, the same treatment as for a dye, supra, may be carried out, but in addition a graft treatment may be performed with a substance that reacts with the surface functional groups on the carbon black, for example, a polyorganosiloxane.

<The Release Agent>

Waxes that are solid at room temperature are preferred for use as the release agent in the present invention from the standpoints of the blocking resistance, multisheet durability, low-temperature fixability, and offset resistance.

These waxes can be exemplified by the following: polymethylene waxes such as paraffin waxes, polyolefin waxes, microcrystalline waxes, and Fischer-Tropsch waxes, as well as amide waxes, higher fatty acids, long-chain alcohols, and ester waxes and the graft compounds and block compounds of the preceding. A single one of these may be used or two or more may be used in combination.

The wax is preferably a wax from which the low molecular weight component has been removed to provide a sharp maximum endothermic peak in the endothermic curve obtained with a differential scanning calorimeter. The wax is incorporated, expressed with reference to 100 mass parts of the polymerizable monomer or binder resin, preferably at 3 to 20 mass parts and more preferably at 5 to 15 mass parts. The use of a straight-chain ester wax is particularly favorable for improving the translucence of the fixed image in OHP applications. The straight-chain ester wax is incorporated, expressed with reference to 100 mass parts of the polymerizable monomer or binder resin, preferably at 1 to 40 mass parts and more preferably at 4 to 30 mass parts.

In order to increase the plasticity of the toner particles and enhance the fixing performance in the low temperature region, the combination with a second release agent having a melting point below 80° C. may be used in the present invention. Waxes of straight-chain alkyl alcohols, straight-chain fatty acids, straight-chain acid amides, straight-chain esters, or montan derivatives, having from 15 to 100 carbons, are preferably used as the second release agent. Impurities such as liquid fatty acids are more preferably removed from these waxes in advance.

<The Charge Control Agent>

The toner particles produced by the present invention may contain a charge control agent. A known charge control agent may be used for this. For example, the following organometal compounds and chelate compounds are effective as charge control agents that control the toner to a negative chargeability: monoazo-type dye metal compounds; acetylacetone metal compounds; aromatic hydroxycarboxylic acids and aromatic mono- and polycarboxylic acids and their metal salts, anhydrides, and esters; and phenol derivatives such as bisphenol. Additional examples are urea derivatives; metal-containing salicylic acid-type compounds; quaternary ammonium salts; calixarene; silicon compounds; styrene-acrylic acid copolymers; styrene-methacrylic acid copolymers; copolymers between styrene monomer and a sulfonic acid group-containing acrylic monomer; copolymers between styrene monomer and a sulfonic acid group-containing methacrylic monomer; and metal-free carboxylic acid-type compounds.

Charge control agents that control the toner to a positive chargeability can be exemplified by the following: nigrosine and its modifications with fatty acid metal salts; quaternary ammonium salts such as tributylbenzylammonium 1-hydroxy-4-naphthosulfonic acid salts and tetrabutylammonium tetrafluoroborate; onium salts, such as phosphonium salts, and their lake pigments; triphenylmethane dyes and their lake pigments (the laking agent can be exemplified by phosphotungstic acid, phosphomolybdic acid, phosphotungstomolybdic acid, tannic acid, lauric acid, gallic acid, ferricyanide, and ferrocyanide); and metal salts of higher fatty acids. A single one of these may be used or two or more may be used in combination. Among the preceding, the use of charge control agents such as the quaternary ammonium salts is particularly preferred.

These charge control agents can be used at generally 0.01 to 20 mass parts and preferably 0.5 to 10 mass parts, per 100 mass parts of the polymerizable monomer.

<The Polymerization Initiator>

Polymerization initiators usable in the present invention include azo-type polymerization initiators. The azo-type polymerization initiators can be exemplified by the following: 2,2'-azobis(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobismethylbutyronitrile.

An organoperoxide-type initiator may also be used. The organoperoxide-type initiator can be exemplified by the following: benzoyl peroxide, methyl ethyl ketone peroxide, diisopropyl peroxycarbonate, cumene hydroperoxide, 2,4-dichlorobenzoyl peroxide, lauroyl peroxide, and tert-butyl peroxypivalate.

A redox initiator, which is the combination of an oxidizing substance and a reducing substance, may also be used. The oxidizing substance can be exemplified by inorganic peroxides such as hydrogen peroxide and persulfate salts (sodium salt, potassium salt, and ammonium salt) and by oxidizing metal salts such as cerium(IV) salts. The reducing substance can be exemplified by reducing metal salts (iron(II) salts, copper(I) salts, and chromium(III) salts); ammonia; lower amines (amines having 1 to 6 carbons, such as methylamine and ethylamine); amino compounds such as hydroxylamine; reducing sulfur compounds such as sodium thiosulfate, sodium hydrosulfite, sodium bisulfite, sodium sulfite, and sodium formaldehyde sulfoxylate; lower alcohols (1 to 6 carbons); ascorbic acid and its salts; and lower aldehydes (1 to 6 carbons). The initiator is selected with reference to its 10-hour half-life temperature, and a single initiator or a mixture of initiators may be used. The amount of addition of the polymerization initiator will vary with the desired degree of polymerization, but it is generally added at 0.5 mass parts to 20 mass parts per 100 mass parts of the polymerizable monomer.

<The Crosslinking Agent>

Various crosslinking agents may also be used in the present invention. The crosslinking agent can be exemplified by the following: divinylbenzene, 4,4'-divinylbiphenyl, hexanediol diacrylate, ethylene glycol diacrylate, ethylene glycol dimethacrylate, diethylene glycol diacrylate, diethylene glycol dimethacrylate, glycidyl acrylate, glycidyl methacrylate, trimethylolpropane triacrylate, and trimethylolpropane trimethacrylate. A single one of these may be used or two or more may be used in combination.

<The Binder Resin>

There are no particular limitations on the binder resin used in the suspension polymerization method and dissolution suspension method in the present invention, and a suitable selection may be made from among known binder resins, for example, the homopolymers and copolymers of styrenes such as styrene and chlorostyrene; monoolefins such as ethylene, propylene, and butylene; vinyl esters such as vinyl acetate, vinyl propionate, vinyl benzoate, and vinyl butyrate; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ethers such as vinyl methyl ether, vinyl ethyl ether, and vinyl butyl ether; and vinyl ketones such as vinyl methyl ketone, vinyl hexyl ketone, and vinyl isopropenyl ketone.

The polymers of styrene and its substituted forms can be exemplified by polystyrene, poly-p-chlorostyrene, and polyvinyltoluene. The styrenic copolymers can be exemplified by styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, and styrene-maleate ester copolymers.

Particularly typical binder resins can be exemplified by polystyrene resins, polyester resins, styrene-alkyl acrylate copolymers, styrene-alkyl methacrylate copolymers, styrene-acrylonitrile copolymers, styrene-butadiene copolymers, styrene-maleic anhydride copolymers, polyethylene resins, and polypropylene resins. A single one of these may be used or two or more may be used together.

<The Organic Solvent>

Viewed from the standpoint of facilitating the subsequent solvent removal, the organic solvent used in the dissolution suspension method in the present invention is preferably volatile with a boiling point of less than 100° C. For an organic solvent, a single selection or a combination of two or more selections from, for example, toluene, xylene, benzene, carbon tetrachloride, methylene chloride, 1,2-dichloroethane, 1,1,2-trichloroethane, trichloroethylene, chloroform, monochlorobenzene, dichlorobenzene, methyl acetate, ethyl acetate, butyl acetate, methyl ethyl ketone, and methyl isobutyl ketone, may be used. When the resin dissolved or dispersed in the organic solvent is a resin that has a polyester skeleton, ester solvents such as methyl acetate, ethyl acetate, and butyl acetate and ketone solvents such as methyl ethyl ketone and methyl isobutyl ketone are preferred for the high solubility they provide. Among the preceding, methyl acetate, ethyl acetate, and methyl ethyl ketone are particularly preferred for their high solvent removability.

<The Modified Resin Added to the Organic Solvent>

The modified resin (also referred to as a "prepolymer" herebelow) preferred for use in the dissolution suspension method in the present invention should have at least a segment reactive with an active hydrogen group-containing compound, but is not otherwise particularly limited, and a suitable selection can be made from among known resins. Examples here are polyol resins, polyacrylic resins, polyester resins, and epoxy resins and derivative resins of the preceding.

A single one of these may be used or two or more may be used in combination. Among the preceding, polyester resins are particularly preferred from the standpoint of a high flowability when melted and from the standpoint of the transparency.

The segment reactive with an active hydrogen group-containing compound in this prepolymer is not particularly limited and a suitable selection can be made from the known substituents, and examples here are the isocyanate group, epoxy group, carboxyl group, and acid chloride group.

A single one of these may be present or two or more may be present. The isocyanate group is particularly preferred among the preceding.

<The Active Hydrogen Group-Containing Compound>

An active hydrogen group-containing compound preferred for use in the dissolution suspension method functions as, for example, a chain extension agent or crosslinking agent through, for example, a chain-extension reaction or crosslinking reaction between the active hydrogen group-containing compound and the therewith reactive modified resin.

The active hydrogen group-containing compound should have an active hydrogen group but is not otherwise particularly limited, and can be selected as appropriate in accordance with the particular objective. For example, when the polymer reactive with the active hydrogen group-containing compound is the previously indicated isocyanate group-containing polyester prepolymer, an amine is preferred from the standpoint of enabling a high molecular weight to be reached by the reaction, e.g., a chain-extension reaction or crosslinking reaction, with the isocyanate group-containing polyester prepolymer.

There are no particular limitations on this active hydrogen group and it may be selected as appropriate in accordance with the particular objective, and examples are the hydroxyl group (alcoholic hydroxyl group or phenolic hydroxyl group), amino group, carboxyl group, and mercapto group. A single active hydrogen group-containing compound may be used or two or more may be used in combination. Among the preceding, compounds bearing an alcoholic hydroxyl group are particularly preferred.

<External Additives>

An external additive may be used with the toner particles according to the present invention for the purpose of imparting various properties to the toner. Viewed from the standpoint of the durability when added to toner, the external additive preferably has a particle diameter that is not more than one-tenth of the average particle diameter of the toner particles. The external additive can be exemplified by the following: metal oxides such as aluminum oxide, titanium oxide, strontium titanate, cerium oxide, magnesium oxide, chromium oxide, tin oxide, and zinc oxide; nitrides such as silicon nitride; carbides such as silicon carbide; inorganic metal salts such as calcium sulfate, barium sulfate, and calcium carbonate; fatty acid metal salts such as zinc stearate and calcium stearate; and carbon black and silica.

These external additives are used at 0.01 to 10 mass parts and preferably 0.05 to 5 mass parts per 100 mass parts of the toner particles. A single external additive may be used or a plurality may be used in combination, and in each case an external additive that has been subjected to a hydrophobic treatment is more preferred.

<Magnetic Materials>

The production method of the present invention may also be applied to the production of magnetic material-containing magnetic toners, and the magnetic material present in the toner may also function as a colorant. The magnetic material present in the magnetic toner in the present invention can be exemplified by iron oxides such as magnetite, hematite, and ferrite; metals such as iron, cobalt and nickel, and alloys of these metals with metals such as aluminum, cobalt, copper, lead, magnesium, tin, zinc, antimony, beryllium, bismuth, cadmium, calcium, manganese, selenium, titanium, tungsten, and vanadium; and mixtures of the preceding.

These magnetic materials should have a volume-average particle diameter (Dv) of not more than 0.5 μm and preferably of about 0.1 to 0.5 μm.

With regard to the volume-average particle diameter (Dv) of these magnetic materials, using a transmission electron microscope (TEM) a determination is made of the circle-equivalent diameter equal to the projected area for 100 magnetic materials in the field of view in a photograph taken at an enlargement of 10,000× to 40,000×, and the volume-average particle diameter is calculated based on this.

The magnetic material content in the toner is preferably 20 to 200 mass parts per 100 mass parts of the polymerizable monomer and is particularly preferably 40 to 150 mass parts per 100 mass parts of the polymerizable monomer.

These magnetic materials preferably have the following magnetic properties under the application of 800 kA/m: a saturation magnetization (σs) of 50 to 200 $Am^2/kg$ and a residual magnetization (σr) of 2 to 20 $Am^2/kg$. The magnetic properties of the magnetic materials are measured using a VSM P-1-10 vibrating magnetometer (from Toei Industry Co., Ltd.) at an external magnetic field of 79.6 kA/m at a room temperature of 25° C.

<The Hydrophobic Agent>

The surface of the magnetic material is preferably also subjected to a hydrophobic treatment in order to improve the dispersibility of these magnetic materials in the toner particles. A coupling agent, for example, a silane coupling agent or a titanium coupling agent, is used for this hydrophobic treatment. Silane coupling agents are preferably used therebetween. The silane coupling agent can be exemplified by a single selection or two or more selections from the following: vinyltrimethoxysilane, vinyltriethoxysilane, γ-methacryloxypropyltrimethoxysilane, vinyltriacetoxysilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-hexadecyltrimethoxysilane, and n-octadecyltrimethoxysilane.

As noted above, the toner particles produced according to the present invention can be used as both a one-component developer and a two-component developer.

In the case, for a one-component developer, of a magnetic toner that contains magnetic materials in the toner, a method is used in which the magnetic toner is transported and charged using magnets incorporated within a developing sleeve. When a nonmagnetic toner lacking magnetic materials is used, forced triboelectric charging is performed at the developing sleeve using a blade and a fur brush and transport is carried out through attachment of the toner on the sleeve.

When the toner obtained by the production method of the present invention is used as a two-component developer, it is used as a developer by using a carrier in combination with the toner. While there are no particular limitations on the carrier used in the present invention, it is mainly constituted of a simple or complex ferrite state composed of the iron, copper, zinc, nickel, cobalt, manganese, and chromium atoms.

The carrier shape is also critical from the standpoint of being able to control the saturation magnetization and electrical resistance in broad ranges, and, for example, a spherical, flat, or irregular shape is preferably selected and in addition the microstructure of the carrier particle surface state, for example, the surface unevenness, is also preferably controlled. A method is generally used in which the carrier core particles are preliminarily produced by firing a metal compound as described above and then granulating and subsequently coating with a resin. Considering the significance of reducing the load by the carrier on the toner, a method may also be used in which a low-density dispersed carrier is obtained by kneading the metal compound with a resin followed by pulverization and classification, or a method may be used in which the metal compound+polymerizable monomer kneadate is directly suspension polymerized in an aqueous medium to obtain a dispersed polymerized carrier in spherical form.

With regard to measurement of the particle diameter of the carrier, this is measured as the volume-based 50% average particle diameter of the carrier using a laser diffraction particle size distribution analyzer (<HELOS>) equipped with a dry disperser (<RODOS>) from Sympatec GmbH.

The average particle diameter of these carriers is preferably 10 to 100 μm and more preferably 20 to 50 μm.

When a two-component developer is prepared, excellent results are generally obtained when the mixing ratio between the carrier and toner of the present invention is made 2 mass % to 15 mass % as the toner concentration in the developer and preferably 4 mass % to 13 mass % as the toner concentration in the developer.

EXAMPLES

The present invention is specifically described below using examples, but this in no way limits the present invention.

The measurement methods used with the present invention are as follows.

<Method for Measuring the Weight-Average Particle Diameter (D4) and the Number-Average Particle Diameter (D1)>

The weight-average particle diameter (D4) and the number-average particle diameter (D1) of the toner particle are calculated as follows. A "Coulter Counter Multisizer 3" (registered trademark of Beckman Coulter, Inc.), which is a precision particle size distribution analyzer that uses the pore electrical resistance method and is equipped with a 100 μm aperture tube, is used as the measurement instrumentation. The "Beckman Coulter Multisizer 3 Version 3.51" dedicated software (from Beckman Coulter, Inc.) provided with the instrument is used to set the measurement conditions and perform measurement data analysis. The measurements are performed in 25,000 channels for the number of effective measurement channels.

A solution of special-grade sodium chloride dissolved in ion-exchanged water and brought to a concentration of approximately 1 mass %, for example, "ISOTON II" (Beckman Coulter, Inc.), can be used for the aqueous electrolyte solution used for the measurement.

The dedicated software was set as follows prior to running the measurement and analysis.

On the "Change Standard Operating Method (SOM)" screen of the dedicated software, the total count number for the control mode is set to 50000 particles, the number of measurements is set to 1, and the value obtained using "10.0 μm standard particles" (from Beckman Coulter, Inc.) is set for the Kd value. The threshold value and noise level are automatically set by pressing the "threshold value/noise level measurement button". The current is set to 1600 μA, the gain is set to 2, the electrolyte solution is set to ISOTON II, and "flush aperture tube after measurement" is checked.

On the "pulse-to-particle diameter conversion setting" screen of the dedicated software, the bin interval is set to logarithmic particle diameter, the particle diameter bin is set to 256 particle diameter bins, and the particle diameter range is set to from 2 μm to 60 μm.

The specific measurement method is as follows.

1) Approximately 200 mL of the above-described aqueous electrolyte solution is introduced into the glass 250-mL roundbottom beaker provided for use with the Multisizer 3 and this is then set into the sample stand and counterclockwise stirring is performed with a stirring rod at 24 rotations per second. Dirt and bubbles in the aperture tube are removed using the "aperture flush" function of the dedicated software.

2) Approximately 30 mL of the above-described aqueous electrolyte solution is introduced into a glass 100-mL flatbottom beaker. To this is added the following as a dispersing agent: approximately 0.3 mL of a dilution prepared by diluting "Contaminon N" (a 10 mass % aqueous solution of a neutral pH 7 detergent for cleaning precision measurement instrumentation, comprising a nonionic surfactant, an anionic surfactant, and an organic builder, from Wako Pure Chemical Industries, Ltd.) approximately 3-fold on a mass basis with ion-exchanged water.

3) An "Ultrasonic Dispersion System Tetora 150" ultrasound disperser (Nikkaki Bios Co., Ltd.), which has an output of 120 W and is equipped with two oscillators oscillating at 50 kHz and configured with a phase shift of 180°, is prepared. Approximately 3.3 L of ion-exchanged water is introduced into the water tank of this ultrasound disperser, and approximately 2 mL of Contaminon N is added to this water tank.

4) The beaker from 2) is placed in the beaker holder of the ultrasound disperser and the ultrasound disperser is activated. The height position of the beaker is adjusted to provide the maximum resonance state for the surface of the aqueous electrolyte solution in the beaker.

5) While exposing the aqueous electrolyte solution in the beaker of 4) to the ultrasound, approximately 10 mg of the toner particles is added in small portions to the aqueous electrolyte solution and is dispersed. The ultrasound dispersing treatment is continued for another 60 seconds. During ultrasound dispersion, the water temperature in the water tank is adjusted as appropriate to be at least 10° C. but no more than 40° C.

6) Using a pipette, the aqueous electrolyte solution from 5) containing dispersed toner particles is added dropwise into the roundbottom beaker of 1) that is installed in the sample stand and the measurement concentration is adjusted to approximately 5%. The measurement is run until the number of particles measured reaches 50000.

7) The measurement data is analyzed by the dedicated software provided with the instrument to calculate the weight-average particle diameter (D4) and the number-average particle diameter (D1). When the dedicated software is set to graph/volume %, the "average diameter" on the "analysis/volume statistics (arithmetic average)" screen is the weight-average particle diameter (D4), and when the dedicated software is set to graph/number %, the "average diameter" on the "analysis/numerical statistics (arithmetic average)" is the number-average particle diameter (D1).

<Method for Calculating the Coarse Particle Amount>

The volume-based coarse particle amount (volume %) in the toner particles is calculated by data analysis after the previously described measurement with the Multisizer 3 has been performed.

The volume % of particles not less than 12.0 μm in the toner particles is calculated using the following procedure. First, the measurement results chart is made a volume % display by setting to graph/volume % in the dedicated software. In addition, ">" is checked in the particle diameter setting section on the "format/particle diameter/particle diameter statistics" screen, and "12" is input in the particle diameter input area below this. When the "analysis/volume statistics (arithmetic average)" is then displayed, the numerical value in the ">12 μm" display area is the volume % of particles not less than 12.0 μm in the toner particles. This volume % not less than 12 μm was taken to be the coarse particle amount.

<Method for Calculating the Scale Increment>

The scale growth-associated increase in the time required to raise the temperature in the vessel is determined for the polymerization step or solvent removal step/maturation step. t1 is made the time required, after the interior of the vessel has been cleaned, to raise or lower the temperature in the polymerization step or solvent removal step/maturation step for the first batch, and tn is made the time required, for the same vessel, to raise or lower the temperature in the polymerization step or solvent removal step/maturation step for the $n^{th}$ batch. The scale increment is then calculated from $$\text{scale increment (\%)}=\{(tn-t1)/t1\}\times 100.$$

<The Glass Lining Treatment>

The glass lining treatment of the vessel 1 in the examples used high-durability 9000 glass from Kobelco Eco-Solutions Co., Ltd.

Example 1

Preparation of Liquid A

The use amounts for the materials were adjusted at the following ratios so as to provide a total amount of liquid A of 100 kg.

45.0 mass parts of ion-exchanged water, 9.0 mass parts of $Na_3PO_4$, and 4.0 mass parts of 10% hydrochloric acid were introduced into the vessel 1 shown in FIG. 1 and, while stirring at 50 rpm, hot water was injected into the jacket 6 and heating to 60° C. was performed. To this was added an aqueous solution of 5.0 mass parts of $CaCl_2$ dissolved in 37.0 mass parts of ion-exchanged water, and stirring was continued for 1 hour at 60° C. to obtain a 4.0 mass % calcium phosphate colloidal solution (liquid A).

(Application of Liquid A)

Then, while continuing temperature control of liquid A to 60° C., the vessel discharge valve 9 was opened and the circulation pump 11 was started. Application was performed for 10 minutes by contacting liquid A, through the circulation line 10 and from the shower nozzle 13 from the top of the vessel, with the stirring blade 2 and baffle 3 and the regions on the inner wall of the glass lining-treated vessel 1 that could come into contact with the polymerizable monomer composition. The circulation pump 11 was then stopped and the vessel discharge valve 9 was closed and the inner wall of the vessel 1 was subsequently dried by heat transfer from the jacket 6, thereby adhering calcium phosphate to the interior of the vessel 1.

(Production of Toner Particle 1)

Toner particle 1 was produced using the following procedure. The use amounts for the materials were adjusted at the following ratios so the total amount of the aqueous medium plus polymerizable monomer composition was 500 kg.

(Preparation of the Aqueous Medium)

5.0 mass parts of $Na_3PO_4$ and 2.0 mass parts of 10% hydrochloric acid were added to 330 mass parts of ion-exchanged water, and, while stirring at 3,000 r/min using a High Shear Mixer (IKA), hot water was injected into the jacket 6 and heating to 60° C. was performed. To this was added an aqueous solution of 3.0 mass parts of $CaCl_2$ dissolved in 20 mass parts of ion-exchanged water to prepare a 1.6 mass % calcium phosphate aqueous medium with a pH of 5.2.

(Preparation of the Polymerizable Monomer Composition)

A solution was prepared by dissolving the following materials at 100 r/min with a propeller-type stirrer.

| | |
|---|---|
| styrene | 70.0 mass parts |
| n-butyl acrylate | 30.0 mass parts |
| sulfonic acid group-containing resin (Acrybase FCA-1001-NS, Fujikura Kasei Co., Ltd.) | 2.0 mass parts |
| styrene-methacrylic acid-methyl methacrylate-α-methylstyrene copolymer (styrene/methacrylic acid/methyl methacrylate/α-methylstyrene = 80.85/2.50/1.65/15.0, peak top molecular weight (Mp) = 19,700, glass transition temperature (Tg) = 96° C., acid value = 12.0 mg KOH/g, weight-average molecular weight/number-average molecular weight (Mw/Mn) = 2.1) | 20.0 mass parts |

The following materials were then added to this solution.

| | |
|---|---|
| C.I. Pigment Blue 15:3 | 7.0 mass parts |
| negative charge control agent (BONTRON E-88, Orient Chemical Industries Co., Ltd.) | 1.0 mass parts |
| hydrocarbon wax with a melting point of 77° C. (HNP-51, Nippon Seiro Co., Ltd.) | 10.0 mass parts |

This mixture was heated to a temperature of 60° C. and was then stirred at 9,000 r/min with a TK Homomixer (Tokushu Kika Kogyo Co., Ltd.) to carry out dissolution and dispersion.

9.0 mass parts of the polymerization initiator 2,2'-azobis (2,4-dimethylvaleronitrile) was dissolved therein to prepare a polymerizable monomer composition.

(The Granulation Step)

This polymerizable monomer composition was introduced into the aqueous medium described above and a dispersion of the polymerizable monomer composition was obtained by stirring for 10 minutes at a temperature of 60° C. at 3000 r/min using a High Shear Mixer (IKA).

(The Polymerization Step)

After the completion of the granulating step, the dispersion of the polymerizable monomer composition was transported into the vessel 1 of FIG. 1, which continued to be under temperature control to 60° C.; stirring at 80 r/min was started and the temperature was raised to 70° C.; and a reaction was then run for 5 hours at 70° C. The internal temperature of the jacket was subsequently set to 95° C. and the temperature within the vessel 1 was raised to 80° C. and the reaction was run for another 5 hours at 80° C. to produce toner particle 1. The time required at this point to raise the temperature from 70° C. to 80° C. was 30 minutes. After the completion of the polymerization reaction, the slurry containing the toner particles 1 was cooled to 35° C. and was transported to the distillation step.

(Washing with Liquid B)

After the slurry had been discharged, the interior of the vessel 1 of FIG. 1 was thoroughly washed with ion-exchanged water. After the washing, the inner wall of the vessel 1 was visually inspected, and it was noted that faint scale deposits had been produced on the inner wall of the vessel 1. After the washing, dilute hydrochloric acid was added to 100 kg of ion-exchanged water, and, while stirring at 80 rpm with the stirring blade 2 at normal temperature, the concentration was adjusted to give a pH of 2.0, thus producing the liquid B. Then, while continuing to stir at 80 rpm, the vessel discharge valve 9 shown in FIG. 1 was opened and the circulation pump 11 was started. The liquid B was brought into contact, through the circulation line and from the shower nozzle 13 from the top of the vessel, with the stirring blade 2 and baffle and the regions of the inner wall of the vessel 1 that could come into contact with the aqueous dispersion containing the polymerizable monomer composition, thereby dissolving the calcium phosphate adhered to the interior of the vessel 1. After 30 minutes the pump was stopped and the circulation of liquid B was suspended and the liquid B was subsequently discharged from the vessel through the vessel discharge valve 9. When the inner wall of the vessel 1 was visually inspected after the liquid B had been discharged, no scale deposits remained at all on the inner wall of the vessel 1, and it was thought that each of the calcium phosphates used as inorganic dispersing agents had been completely removed. The conditions are shown in Table 1 for the (Application of liquid A) and (Washing with liquid B).

After the completion of 20 batches of the process up to this point using the vessel 1, the interior of the vessel 1 was visually inspected: the inner wall of the vessel 1 was seen to be completely free of scale deposits and no scale deposit growth was observed. The scale increment was determined from the times taken to raise the temperature from 70° C. to 80° C. for the first and twentieth batches. The properties of toner particle 1 for the first and twentieth batches and the scale increment are given in Table 2. The results are given in Table 2.

Example 2

Preparation of Liquid A

Liquid A was obtained by diluting a commercial calcium phosphate colloidal solution (TCP-10U, Taihei Chemical Industrial Co., Ltd.) with ion-exchanged water to adjust to a 4.0 mass % calcium phosphate colloidal solution.

(Application of Liquid A)

100 kg of liquid A was fed into the interior of the glass lining-treated vessel 1 from the liquid A feed line 14 in FIG. 1 to effect contact with and application to the entire inner wall of the vessel 1.

Subsequent to this, the temperature was raised to 60° C. and, while continuing to control the temperature at 60° C., the vessel discharge valve 9 in FIG. 1 was opened and the circulation pump 11 was started. Application was performed for an interval of 10 minutes by contacting liquid A, through the circulation line and from the shower nozzle 13 from the top of the vessel, with the inner wall of the vessel 1, stirring blade 2, and baffle 3. The circulation pump 11 was then stopped and the vessel discharge valve 9 was closed and the inner wall of the vessel 1 was subsequently dried by heat transfer from the jacket 6, thereby adhering calcium phosphate to the interior of the vessel 1.

Other than the preceding, toner particle 2 was obtained by the same method as described for Example 1.

After the completion of 20 batches of the process up to this point using the vessel 1, the interior of the vessel 1 was visually inspected: scale deposits in trace amounts were seen in several locations on the inner wall of the vessel 1. However, the glass lining layer on the inner wall of the vessel 1 was in a substantially exposed state, and a thorough inhibitory effect on scale deposition could thus be confirmed. In addition, the scale increment was determined from the times taken to raise the temperature from 70° C. to 80° C. for the first and twentieth batches. The properties of toner particle 2 for the first and twentieth batches and the scale increment are given in Table 2.

Example 3

Preparation of Liquid A

The use amounts for the materials were adjusted at the following ratios so as to provide a total amount of liquid A of 600 kg.

45.0 mass parts of ion-exchanged water, 9.0 mass parts of $Na_3PO_4$, and 4.0 mass parts of 10% hydrochloric acid were introduced into the vessel 1 shown in FIG. 1 and, while stirring at 50 rpm, hot water was injected into the jacket 6 and heating to 60° C. was performed. To this was added an aqueous solution of 5.0 mass parts of $CaCl_2$ dissolved in 37.0 mass parts of ion-exchanged water, and stirring was continued for 10 minutes at 60° C. to obtain a 4.0 mass % calcium phosphate colloidal solution (liquid A).

(Application of Liquid A)

The vessel discharge valve 9 in FIG. 1 was opened and the entire amount of liquid A was discharged from the vessel 1. Temperature control to 60° C. within the jacket 6 was also continued after discharge, and the inner wall of the glass lining-treated vessel 1 was dried by heat transfer from the jacket 6, thereby adhering calcium phosphate to the interior of the vessel 1.

Toner particle 3 was thereafter obtained by completing the same procedure as in Example 1 up to and including the polymerization step.

(Washing with Liquid B)

After the slurry had been discharged, the interior of the vessel 1 was thoroughly washed with ion-exchanged water. After the washing, the inner wall of the vessel 1 was visually inspected, and it was noted that faint scale deposits had been produced on the inner wall of the vessel 1. After the washing, dilute hydrochloric acid was added to 600 kg of ion-exchanged water, and, while stirring at 80 rpm with the stirring blade 2 at normal temperature, the concentration was adjusted to give a pH of 2.0, thus producing the liquid B. Then, while continuing to stir at 80 rpm, the calcium phosphate adhered to the inner wall of the vessel 1 was dissolved. After 30 minutes the stirring was stopped and the liquid B was discharged from the vessel 1 through the vessel discharge valve 9. When the inner wall of the vessel 1 was visually inspected after the liquid B had been discharged, no scale deposits remained at all, and it was thought that each of the calcium phosphates used as inorganic dispersing agents had been completely removed.

After the completion of 20 batches of the process up to this point using the vessel 1, the interior of the vessel 1 was visually inspected: the inner wall of the vessel 1 was seen to be completely free of scale deposits and no scale deposit growth was observed. The scale increment was determined from the times taken to raise the temperature from 70° C. to 80° C. for the first and twentieth batches. The properties of toner particle 3 for the first and twentieth batches and the scale increment are given in Table 2.

Example 4

Preparation of Liquid A

Liquid A was obtained by diluting a commercial calcium phosphate colloidal solution (TCP-10U, Taihei Chemical Industrial Co., Ltd.) with ion-exchanged water to adjust to a 4.0 mass % calcium phosphate colloidal solution.

(Application of Liquid A)

600 kg of liquid A was brought into contact with and applied to the entire inner wall of the glass lining-treated vessel 1 from the liquid A feed line 14 in FIG. 1. Subsequent to this, the temperature was raised to 60° C. and, while continuing to control the temperature at 60° C., stirring was performed for 10 minutes. The vessel discharge valve 9 was then opened and the entire amount of the liquid A was discharged from the vessel 1. Temperature control to 60° C. within the jacket 6 was also continued after discharge, and the inner wall of the vessel 1 was dried by heat transfer from the jacket 6, thereby adhering calcium phosphate to the interior of the vessel 1.

Toner particle 4 was thereafter obtained by completing the same procedure as in Example 1 up to and including the polymerization step.

(Washing with Liquid B)

After the slurry had been discharged, the interior of the vessel 1 was thoroughly washed with ion-exchanged water. After the washing, the inner wall of the vessel 1 was visually inspected, and it was noted that faint scale deposits had been produced on the inner wall of the vessel 1. After the washing, dilute hydrochloric acid was added to 600 kg of ion-exchanged water, and, while stirring at 80 rpm with the stirring blade 2 at normal temperature, the concentration was adjusted to give a pH of 2.0, thus producing the liquid B. Then, while continuing to stir at 80 rpm, the calcium phosphate adhered to the inner wall of the vessel 1 was dissolved. After 30 minutes the stirring was stopped and the liquid B was discharged from the vessel 1 through the vessel discharge valve 9.

After the completion of 20 batches of the process up to this point using the vessel 1, the interior of the vessel 1 was visually inspected: scale deposits in trace amounts were seen in several locations on the inner wall of the vessel 1. However, the glass lining layer on the inner wall of the vessel 1 was in a substantially exposed state, and a thorough inhibitory effect on scale deposition could thus be confirmed. The scale increment was determined from the times taken to raise the temperature from 70° C. to 80° C. for the first and twentieth batches. The properties of toner particle 4 for the first and twentieth batches and the scale increment are given in Table 2.

Example 5

Toner particle 5 was produced by carrying out the same procedures as in Example 4 with the exception of the washing with the liquid B.

(Washing with Liquid B)

After the slurry had been discharged, the interior of the vessel 1 of FIG. 1 was thoroughly washed with ion-exchanged water. After the washing, the inner wall of the vessel 1 was visually inspected, and it was noted that faint scale deposits had been produced on the inner wall of the vessel 1. After the washing, dilute hydrochloric acid was added to 600 kg of ion-exchanged water, and, while stirring at 80 rpm with the stirring blade 2 at normal temperature, the concentration was adjusted to give a pH of 3.0, thus producing the liquid B. Then, while continuing to stir at 80 rpm, the calcium phosphate adhered to the inner wall of the vessel 1 was dissolved. After 30 minutes the stirring was stopped and the liquid B was discharged from the vessel 1 through the vessel discharge valve 9. The inner wall of the vessel 1 was visually inspected after the liquid B had been discharged: the scale deposits on the inner wall of the vessel 1 had not been completely removed, and, while the glass lining layer on the inner wall of the vessel 1 was mostly exposed, scale deposits did remain in several locations.

After the completion of 20 batches of the process up to this point using the vessel 1, the interior of the vessel 1 was visually inspected: scale deposits were seen in several locations on the inner wall of the vessel 1. In addition, scale deposition was somewhat worse than after washing with the liquid B and discharging thereof at the first batch. However, the glass lining layer on the inner wall of the vessel 1 was approximately 70% exposed, and an inhibitory effect on scale deposition could thus be confirmed. The scale increment was determined from the times taken to raise the temperature from 70° C. to 80° C. for the first and twentieth batches. The properties of toner particle 5 for the first and twentieth batches and the scale increment are given in Table 2.

Example 6

Toner particle 6 was produced by carrying out the same procedures as in Example 4 with the exception of the washing with the liquid B.

(Washing with Liquid B)

After the slurry had been discharged, the interior of the vessel 1 of FIG. 1 was thoroughly washed with ion-exchanged water. After the washing, the inner wall of the vessel 1 was visually inspected, and it was noted that faint scale deposits had been produced on the inner wall of the vessel 1. After the washing, dilute hydrochloric acid was added to 600 kg of ion-exchanged water, and, while stirring at 80 rpm with the stirring blade 2 at normal temperature, the concentration was adjusted to give a pH of 4.2, thus producing the liquid B. Then, while continuing to stir at 80 rpm, the calcium phosphate adhered to the inner wall of the vessel 1 was dissolved. After 30 minutes the stirring was stopped and the liquid B was discharged from the vessel 1 through the vessel discharge valve 9. The inner wall of the vessel 1 was visually inspected after the liquid B had been discharged: the scale deposits on the inner wall of the vessel 1 had not been completely removed, and, while the glass lining layer on the inner wall of the vessel 1 was exposed, considerable scale deposits did remain.

After the completion of 20 batches of the process up to this point using the vessel 1, the interior of the vessel 1 was visually inspected, and scale deposits were seen on the inner wall of the vessel 1. In addition, scale deposition was clearly worse than after washing with the liquid B and discharging thereof at the first batch. However, the glass lining layer on the inner wall of the vessel 1 was approximately 50% exposed, and an inhibitory effect on scale deposition could thus be confirmed. The scale increment was determined from the times taken to raise the temperature from 70° C. to 80° C. for the first and twentieth batches. The properties of toner particle 6 for the first and twentieth batches and the scale increment are given in Table 2.

Example 7

Preparation of Liquid A

Liquid A was obtained by diluting a commercial magnesium hydroxide (#200 from Konoshima Chemical Co., Ltd.) with ion-exchanged water to adjust to a 4.0 mass % magnesium hydroxide colloidal solution.

(Application of Liquid A)

600 kg of liquid A was brought into contact with and applied to the entire inner wall of the glass lining-treated vessel 1 from the liquid A feed line 14 in FIG. 1. Subsequent to this, the temperature was raised to 60° C. and, while continuing to control the temperature at 60° C., stirring was performed for 10 minutes. The vessel discharge valve 9 was then opened and the entire amount of the liquid A was discharged from the vessel 1. Temperature control to 60° C. within the jacket 6 was also continued after discharge, and the inner wall of the vessel 1 was dried by heat transfer from the jacket 6, thereby adhering magnesium hydroxide to the interior of the vessel 1.

Toner particle 7 was produced using the following procedure. The use amounts for the materials were adjusted at the following ratios so the total amount of the aqueous medium plus polymerizable monomer composition was 500 kg.

(Preparation of the Aqueous Medium)

5.0 mass parts of $Na_3PO_4$ was added to 330 mass parts of ion-exchanged water, and, while stirring at 3,000 r/min using a High Shear Mixer (IKA), hot water was injected into the jacket 6 and heating to 60° C. was performed. To this was added an aqueous solution of 3.0 mass parts of $CaCl_2$ dissolved in 20 mass parts of ion-exchanged water to prepare a 1.6 mass % calcium phosphate aqueous medium with a pH of 10.2.

(Preparation of the Polymerizable Monomer Composition)

A solution was prepared by dissolving the following materials at 100 r/min with a propeller-type stirrer.

| | |
|---|---|
| styrene | 70.0 mass parts |
| n-butyl acrylate | 30.0 mass parts |
| sulfonic acid group-containing resin (Acrybase FCA-1001-NS, Fujikura Kasei Co., Ltd.) | 2.0 mass parts |
| styrene-methacrylic acid-methyl methacrylate-α-methylstyrene copolymer (styrene/methacrylic acid/methyl methacrylate/α-methylstyrene = 80.85/2.50/1.65/15.0, Mp = 19,700, Tg = 96° C., acid value = 12.0 mg KOH/g, Mw/Mn = 2.1) | 20.0 mass parts |

The following materials were then added to this solution.

| | |
|---|---|
| C.I. Pigment Blue 15:3 | 7.0 mass parts |
| negative charge control agent (BONTRON E-88, Orient Chemical Industries Co., Ltd.) | 1.0 mass parts |
| hydrocarbon wax with a melting point of 77° C. (HNP-51, Nippon Seiro Co., Ltd.) | 10.0 mass parts |

This mixture was heated to a temperature of 60° C. and was then stirred at 9,000 r/min with a TK Homomixer (Tokushu Kika Kogyo Co., Ltd.) to carry out dissolution and dispersion.

9.0 mass parts of the polymerization initiator 2,2'-azobis (2,4-dimethylvaleronitrile) was dissolved therein to prepare a polymerizable monomer composition.

Toner particle 7 was thereafter obtained by completing the same procedure as in Example 1 up to and including the polymerization step.

(Washing with Liquid B)

After the slurry had been discharged, the interior of the vessel 1 of FIG. 1 was thoroughly washed with ion-exchanged water. After the washing, the inner wall of the vessel 1 was visually inspected, and it was noted that faint scale deposits had been produced on the inner wall of the vessel 1. After the washing, dilute hydrochloric acid was added to 600 kg of ion-exchanged water, and, while stirring at 80 rpm with the stirring blade 2 at normal temperature, the concentration was adjusted to give a pH of 4.5, thus producing the liquid B. Then, while continuing to stir at 80 rpm, the magnesium hydroxide adhered to the inner wall of the vessel 1 was dissolved. After 30 minutes the stirring was stopped and the liquid B was discharged from the vessel 1 through the vessel discharge valve 9. When the inner wall of the vessel 1 was visually inspected after the liquid B had been discharged, no scale deposits remained at all on the inner wall of the vessel 1, and it was thought that each magnesium hydroxide used as an inorganic dispersing agent had been completely removed.

After the completion of 20 batches of the process up to this point using the vessel 1, the interior of the vessel 1 was visually inspected: the inner wall of the vessel 1 was seen to be completely free of scale deposits and no scale deposit growth was observed. The scale increment was determined from the times taken to raise the temperature from 70° C. to 80° C. for the first and twentieth batches. The properties of toner particle 7 for the first and twentieth batches and the scale increment are given in Table 2.

Example 8

Toner particle 8 was produced by carrying out the same procedures as in Example 7 with the exception of the washing with the liquid B.

(Washing with Liquid B)

After the slurry had been discharged, the interior of the vessel 1 of FIG. 1 was thoroughly washed with ion-exchanged water. After the washing, the inner wall of the vessel 1 was visually inspected, and it was noted that faint scale deposits had been produced on the inner wall of the vessel 1. After the washing, dilute hydrochloric acid was added to 600 kg of ion-exchanged water, and, while stirring at 80 rpm with the stirring blade 2 at normal temperature, the concentration was adjusted to give a pH of 5.5, thus producing the liquid B. Then, while continuing to stir at 80 rpm, the magnesium hydroxide adhered to the inner wall of the vessel 1 was dissolved. After 30 minutes the stirring was stopped and the liquid B was discharged from the vessel 1 through the vessel discharge valve 9. The inner wall of the vessel 1 was visually inspected after the liquid B had been discharged: the scale deposits on the inner wall of the vessel 1 had not been completely removed, and, while the glass lining layer on the inner wall of the vessel 1 was mostly exposed, scale deposits did remain in several locations.

After the completion of 20 batches of the process up to this point using the vessel 1, the interior of the vessel 1 was visually inspected: scale deposits were seen in several locations on the inner wall of the vessel 1. In addition, scale deposition was somewhat worse than after washing with the liquid B and discharging thereof at the first batch. However, the glass lining layer on the inner wall of the vessel 1 was approximately 70% exposed, and an inhibitory effect on scale deposition could thus be confirmed. The scale increment was determined from the times taken to raise the temperature from 70° C. to 80° C. for the first and twentieth batches. The properties of toner particle 8 for the first and twentieth batches and the scale increment are given in Table 2.

Example 9

Toner particle 9 was produced by carrying out the same procedures as in Example 7 with the exception of the washing with the liquid B.

(Washing with Liquid B)

After the slurry had been discharged, the interior of the vessel 1 of FIG. 1 was thoroughly washed with ion-exchanged water. After the washing, the inner wall of the vessel 1 was visually inspected, and it was noted that faint scale deposits had been produced on the inner wall of the vessel 1. After the washing, dilute hydrochloric acid was added to 600 kg of ion-exchanged water, and, while stirring at 80 rpm with the stirring blade 2 at normal temperature, the concentration was adjusted to give a pH of 6.0, thus producing the liquid B. Then, while continuing to stir at 80 rpm, the magnesium hydroxide adhered to the inner wall of the vessel 1 was dissolved. After 30 minutes the stirring was stopped and the liquid B was discharged from the vessel 1 through the vessel discharge valve 9. The inner wall of the vessel 1 was visually inspected after the liquid B had been discharged: the scale deposits on the inner wall of the vessel 1 had not been completely removed, and, while the glass lining layer on the inner wall of the vessel 1 was exposed, considerable scale deposits did remain.

After the completion of 20 batches of the process up to this point using the vessel 1, the interior of the vessel 1 was visually inspected, and scale deposits were seen on the inner wall of the vessel 1. In addition, scale deposition was somewhat worse than after washing with the liquid B and discharging thereof at the first batch. Moreover, the glass lining layer of the vessel 1 itself was approximately 50% exposed, and an inhibitory effect on scale deposition could thus be confirmed. The scale increment was determined from the times taken to raise the temperature from 70° C. to 80° C. for the first and twentieth batches. The properties of toner particle 9 for the first and twentieth batches and the scale increment are given in Table 2.

Example 10

Preparation of Liquid A

Liquid A was obtained by diluting a commercial calcium phosphate colloidal solution (TCP-10U, Taihei Chemical Industrial Co., Ltd.) in the vessel of FIG. 1 with ion-exchanged water to adjust to a 4.0 mass % calcium phosphate colloidal solution.

(Application of Liquid A)

600 kg of the liquid A was fed into the interior of the glass lining-treated vessel 1 from the liquid A feed line 14 in FIG. 1 and was brought into contact with and applied to the entire inner wall of the vessel 1. Subsequent to this, the temperature was raised to 60° C. and, while continuing to control the temperature at 60° C., stirring was performed for 10 minutes.

The vessel discharge valve 9 in FIG. 1 was then opened and the entire amount of the liquid A was discharged from the vessel. Temperature control to 60° C. within the jacket 6 was also continued after discharge, and the inner wall of the vessel was dried by heat transfer from the jacket 6, thereby adhering calcium phosphate to the interior of the vessel 1. The jacket temperature was subsequently changed to 30° C. and temperature control at 30° C. was thereafter continued.

(Production of the Toner Particle 10)

(Preparation of the Aqueous Medium)

5.0 mass parts of $Na_3PO_4$ and 2.0 mass parts of 10% hydrochloric acid were added to 330 mass parts of ion-exchanged water, and, while stirring at 3,000 r/min using a High Shear Mixer (IKA), hot water was injected into the jacket 6 and heating to 60° C. was performed. To this was added an aqueous solution of 3.0 mass parts of $CaCl_2$ dissolved in 20 mass parts of ion-exchanged water and, after 30 minutes, 15 mass parts of a 48.5 mass % aqueous solution of sodium dodecyldiphenyl ether disulfonate (Eleminol MON-7 from Sanyo Chemical Industries, Ltd.) and 30 mass parts ethyl acetate were added; cooling the liquid temperature to 30° C. then produced the aqueous medium.

(Masterbatch Production)

C. I. Pigment Blue 15:3 40 mass parts unmodified polyester resin A 60 mass parts (SREL0-005 from Sanyo Chemical Industries, Ltd.)

were kneaded for 30 minutes at 150° C. on a two-roll mill followed by rolling and cooling and pulverization to obtain a masterbatch.

(Synthesis of Intermediate Polyester and Prepolymer)

| | |
|---|---|
| bisphenol A/2 mol ethylene oxide adduct | 682 mass parts |
| bisphenol A/2 mol propylene oxide adduct | 81 mass parts |
| terephthalic acid | 283 mass parts |
| trimellitic anhydride | 22 mass parts |
| dibutyltin oxide | 2 mass parts |

were introduced into a reactor and were reacted for 8 hours at 230° C. under normal pressure. A reaction was then run for 5 hours at a reduced pressure of 10 to 15 mmHg to synthesize an intermediate polyester.

Then,

| | |
|---|---|
| the intermediate polyester | 410 mass parts |
| isophorone diisocyanate | 89 mass parts |
| ethyl acetate | 500 mass parts |

were introduced and reacted for 5 hours at 100° C. to synthesize a prepolymer.

(Ketimine Synthesis)

170 parts isophoronediamine and 75 parts methyl ethyl ketone were introduced into a reactor and were reacted for 5 hours at 50° C. to synthesize a ketimine compound.

(Production of a Wax Dispersion)

| | |
|---|---|
| unmodified polyester resin (SREL0-005, Sanyo Chemical Industries, Ltd.) | 100 mass parts |
| paraffin wax (HPE-11, Nippon Seiro Co., Ltd.) | 90 mass parts |
| maleic acid-modified paraffin wax (P-166, Chukyo Yushi Co., Ltd.) | 10 mass parts |
| ethyl acetate | 400 mass parts |

were stirred for 10 minutes using a propeller blade to effect dispersion, followed by dispersion for 8 hours using a Dyno Mill to obtain a wax dispersion.

(Production of a Toner Particle Composition)

150 mass parts of the masterbatch, 700 mass parts of the resin A (unmodified polyester resin A), and 850 mass parts of ethyl acetate were introduced into a vessel equipped with a stirring bar and a thermometer and mixing was performed for 10 minutes at 9,000 rpm with a TK Homomixer (Tokushu Kika Kogyo Co., Ltd.).

Then, while cooling the vessel, the TK Homomixer was brought to 1,000 rpm and stirring was performed until the liquid temperature reached 30° C.

Once the liquid temperature had reached 30° C., 200 parts of the wax dispersion was introduced while further cooling the vessel, and mixing and stirring were performed while adjusting the rpm such that the liquid temperature did not reach or exceed 45° C.

194 mass parts of the prepolymer and 6 mass parts of the ketimine compound were additionally added and a toner particle composition was then obtained by stirring for 30 seconds at 5,000 rpm.

(Granulation)

The use amounts of the materials were adjusted at the following ratios so the total amount of the granulation slurry was 600 kg.

60 parts of each toner composition mixture was introduced into a vessel holding 140 mass parts of the aqueous medium and a dispersion of the toner particle composition was obtained by mixing for 10 minutes at 3,000 r/min using a High Shear Mixer (IKA).

(Solvent Removal and Maturation)

After the completion of the granulating step, the dispersion of the toner particle composition was transferred to the vessel shown in FIG. 1, which was continuing to be temperature controlled to 30° C., and stirring at 50 r/min was started and solvent removal was performed for 10 hours. The temperature in the jacket was then set to 80° C. and the temperature within the vessel 1 was raised to 55° C. and an additional maturation was carried out for 5 hours at 55° C. to produce toner particle 10. At this point, the time required to raise the temperature from 30° C. to 55° C. was 30 minutes.

(Washing with Liquid B)

After the dispersion of the toner particle composition had been discharged, the interior of the vessel 1 of FIG. 1 was thoroughly washed with ion-exchanged water. After the washing, the inner wall of the vessel 1 was visually inspected, and it was noted that faint scale deposits had been produced on the inner wall of the vessel 1. After the washing, dilute hydrochloric acid was added to 600 kg of ion-exchanged water, and, while stirring at 80 rpm with the stirring blade 2 at normal temperature, the concentration was adjusted to give a pH of 2.0, thus producing the liquid B. Then, while continuing to stir at 80 rpm, the calcium phosphate adhered to the inner wall of the vessel was dissolved. After 30 minutes the stirring was stopped and the liquid B was discharged from the vessel through the vessel discharge valve 9.

After the completion of 20 batches of the process up to this point using the vessel 1, the interior of the vessel 1 was visually inspected: scale deposits in trace amounts were seen in several locations on the inner wall of the vessel 1. However, the glass lining layer of the vessel itself was substantially exposed, and a thorough inhibitory effect on scale deposition could thus be confirmed. The scale increment was determined from the times taken to raise the temperature from 30° C. to 55° C. for the first and twentieth batches. The properties of toner particle 10 for the first and twentieth batches and the scale increment are given in Table 2.

Example 11

Toner particle 11 was produced by carrying out the same procedures as in Example 10 with the exception of the washing with the liquid B.

(Washing with Liquid B)

After the dispersion of the toner particle composition had been discharged, the interior of the vessel 1 of FIG. 1 was thoroughly washed with ion-exchanged water. After the washing, the inner wall of the vessel 1 was visually inspected, and it was noted that faint scale deposits had been produced on the inner wall of the vessel 1. After the washing, dilute hydrochloric acid was added to 600 kg of ion-exchanged water, and, while stirring at 80 rpm with the stirring blade 2 at normal temperature, the concentration was adjusted to give a pH of 3.0, thus producing the liquid B. Then, while continuing to stir at 80 rpm, the calcium phosphate adhered to the inner wall of the vessel 1 was dissolved. After 30 minutes the stirring was stopped and the liquid B was discharged from the vessel through the vessel discharge valve 9. The inner wall of the vessel 1 was visually inspected after the liquid B had been discharged: the scale deposits on the inner wall of the vessel 1 had not been completely removed, and, while the glass lining region in the vessel was mostly exposed, scale deposits did remain in several locations.

After the completion of 20 batches of the process up to this point using the vessel 1, the interior of the vessel 1 was visually inspected: scale deposits were seen in several locations on the inner wall of the vessel 1. In addition, scale deposition was somewhat worse than after washing with the liquid B and discharging thereof at the first batch. However, the glass lining layer of the vessel itself was approximately 70% exposed, and an inhibitory effect on scale deposition could thus be confirmed. The scale increment was determined from the times taken to raise the temperature from 30° C. to 55° C. for the first and twentieth batches. The properties of toner particle 11 for the first and twentieth batches and the scale increment are given in Table 2.

Example 12

Toner particle 12 was produced by carrying out the same procedures as in Example 10 with the exception of the washing with the liquid B.

(Washing with Liquid B)

After the dispersion of the toner particle composition had been discharged, the interior of the vessel 1 of FIG. 1 was thoroughly washed with ion-exchanged water. After the washing, the inner wall of the vessel 1 was visually inspected, and it was noted that faint scale deposits had been produced on the inner wall of the vessel 1. After the washing, dilute hydrochloric acid was added to 600 kg of ion-exchanged water, and, while stirring at 80 rpm with the stirring blade 2 at normal temperature, the concentration was adjusted to give a pH of 4.2, thus producing the liquid B. Then, while continuing to stir at 80 rpm, the calcium phosphate adhered to the inner wall of the vessel 1 was dissolved. After 30 minutes the stirring was stopped and the liquid B was discharged from the vessel through the vessel discharge valve 9. The inner wall of the vessel 1 was visually inspected after the liquid B had been discharged: the scale deposits on the inner wall of the vessel 1 had not been completely removed, and, while the glass lining region in the vessel was exposed, considerable scale deposits did remain.

After the completion of 20 batches of the process up to this point using the vessel 1, the interior of the vessel was visually inspected: scale deposits were seen on the inner wall of the vessel 1. In addition, scale deposition was somewhat worse than after washing with the liquid B and discharging thereof at the first batch. Moreover, the glass lining layer of the vessel 1 itself was approximately 50% exposed, and an inhibitory effect on scale deposition could thus be confirmed. The scale increment was determined from the times taken to raise the temperature from 30° C. to 55° C. for the first and twentieth batches. The properties of toner particle 12 for the first and twentieth batches and the scale increment are given in Table 2.

Example 13

Toner particle 13 was produced by carrying out the same procedures as in Example 4 with the exception of the washing with the liquid B.

(Washing with Liquid B)

After the slurry had been discharged, the interior of the vessel 1 of FIG. 1 was thoroughly washed with ion-exchanged water. After the washing, the inner wall of the vessel 1 was visually inspected, and it was noted that faint scale deposits had been produced on the inner wall of the vessel 1. After the washing, dilute hydrochloric acid was added to 600 kg of ion-exchanged water and the liquid temperature was heated to 98° C., and, while stirring at 80 rpm with the stirring blade 2, the concentration was adjusted to give a pH of 3.0, thus producing the liquid B. Then, while continuing to stir at 98° C./80 rpm, the calcium phosphate adhered to the inner wall of the vessel 1 was dissolved. After 30 minutes the stirring was stopped and the liquid B was discharged from the vessel 1 through the vessel discharge valve 9. The inner wall of the vessel 1 was visually inspected after the liquid B had been discharged: the scale deposits on the inner wall of the vessel 1 had not been completely removed, and, while the glass lining layer on the inner wall of the vessel 1 was mostly exposed, scale deposits did remain at several locations.

After the completion of 20 batches of the process up to this point using the vessel 1, the interior of the vessel 1 was visually inspected: scale deposits were seen at several locations on the inner wall of the vessel 1. In addition, scale deposition was somewhat worse than after washing with the liquid B and discharging thereof at the first batch. However, the glass lining layer of the inner wall of the vessel 1 was approximately 70% exposed, and an inhibitory effect on scale deposition could thus be confirmed. The scale increment was determined from the times taken to raise the temperature from 70° C. to 80° C. for the first and twentieth batches. The properties of toner particle 13 for the first and twentieth batches and the scale increment are given in Table 2.

Comparative Example 1

Toner particle 14 was produced by carrying out the same procedures as in Example 4 with the exception that the washing with the liquid B was not performed.

After the completion of 20 batches of toner particle production, the interior of the vessel 1 was visually inspected: the growth of scale deposits was seen over the entire surface of the inner wall of the vessel 1, and exposure of the glass lining layer was entirely absent. The properties of the toner particle at the first and twentieth batches and the scale increment are given in Table 2.

Comparative Example 2

Toner particle 15 was produced by carrying out the same procedures as in Example 7 with the exception that the washing with the liquid B was not performed.

After the completion of 20 batches of toner particle production, the interior of the vessel 1 was visually inspected: the growth of scale deposits was seen over the entire surface of the inner wall of the vessel 1, and exposure of the glass lining layer was entirely absent. The properties of the toner particle 15 at the first and twentieth batches and the scale increment are given in Table 2.

Comparative Example 3

Toner particle 16 was produced by carrying out the same procedures as in Example 11 with the exception that the washing with the liquid B was not performed.

After the completion of 20 batches of toner particle production, the interior of the vessel 1 was visually inspected: the growth of scale deposits was seen over the entire surface of the inner wall of the vessel 1, and exposure of the glass lining layer was entirely absent. The properties of the toner particle 16 at the first and twentieth batches and the scale increment are given in Table 2.

Comparative Example 4

Toner particle 17 was produced by carrying out the same procedures as in Example 3 with the exception of the washing with the liquid B.

(Washing with Liquid B)

After the slurry had been discharged, the interior of the vessel 1 of FIG. 1 was thoroughly washed with ion-exchanged water. After the washing, the inner wall of the vessel 1 was visually inspected, and it was noted that faint scale deposits had been produced on the inner wall of the vessel 1. After the washing, sodium hydroxide was added to 600 kg of ion-exchanged water, and, while stirring at 80 rpm with the stirring blade 2, the concentration was adjusted at normal temperature (20° C.) to give a pH of 10.0, thus producing the liquid B. Then, while continuing to stir at 20° C./80 rpm, the calcium phosphate adhered to the inner wall of the vessel 1 was dissolved. After 30 minutes the stirring was stopped and the liquid B was discharged from the vessel 1 through the vessel discharge valve 9. The inner wall of the vessel 1 was visually inspected after the liquid B had been discharged: no parts of the scale deposits on the inner wall of the vessel 1 had been removed.

After the completion of 20 batches of the process up to this point using the vessel 1, the interior of the vessel was visually inspected: scale deposition was worse than after washing with the liquid B and discharging thereof at the first batch; the growth of scale deposits was seen over the entire surface of the inner wall of the vessel 1; and exposure of the glass lining layer was entirely absent.

The scale increment was determined from the times taken to raise the temperature from 70° C. to 80° C. for the first and twentieth batches. The properties of toner particle 17 for the first and twentieth batches and the scale increment are given in Table 2.

Comparative Example 5

Toner particle 18 was produced by carrying out the same procedures as in Example 3 with the exception of the washing with the liquid B.

(Washing with Liquid B)

After the slurry had been discharged, the interior of the vessel 1 of FIG. 1 was thoroughly washed with ion-exchanged water. After the washing, the inner wall of the vessel 1 was visually inspected, and it was noted that faint scale deposits had been produced on the inner wall of the vessel 1. After the washing, sodium hydroxide was added to 600 kg of ion-exchanged water, and, while stirring at 80 rpm with the stirring blade 2, the concentration was adjusted at normal temperature (20° C.) to give a pH of 12.0, thus producing the liquid B. Then, while continuing to stir at 20° C./80 rpm, the calcium phosphate adhered to the inner wall of the vessel 1 was dissolved. After 30 minutes the stirring was stopped and the liquid B was discharged from the vessel 1 through the vessel discharge valve 9. The inner wall of the vessel 1 was visually inspected after the liquid B had been discharged: no parts of the scale deposits on the inner wall of the vessel 1 had been removed.

After the completion of 20 batches of the process up to this point using the vessel 1, the interior of the vessel was visually inspected: scale deposition was worse than after washing with the liquid B and discharging thereof at the first batch; the growth of scale deposits was seen over the entire surface of the inner wall of the vessel 1; and exposure of the glass lining layer was entirely absent.

The scale increment was determined from the times taken to raise the temperature from 70° C. to 80° C. for the first and twentieth batches. The properties of toner particle 18 for the first and twentieth batches and the scale increment are given in Table 2.

Comparative Example 6

Toner particle 19 was produced by carrying out the same procedures as in Example 3 with the exception of the washing with the liquid B.

(Washing with Liquid B)

After the slurry had been discharged, the interior of the vessel 1 of FIG. 1 was thoroughly washed with ion-exchanged water. After the washing, the inner wall of the vessel 1 was visually inspected, and it was noted that faint scale deposits had been produced on the inner wall of the vessel 1. After the washing, sodium hydroxide was added to 600 kg of ion-exchanged water and the liquid temperature was heated to 98° C., and, while stirring at 80 rpm with the stirring blade 2, the concentration was adjusted to give a pH of 10.0, thus producing the liquid B. Then, while continuing to stir at 98° C./80 rpm, the calcium phosphate adhered to the inner wall of the vessel 1 was dissolved. After 30 minutes the stirring was stopped and the liquid B was discharged from the vessel 1 through the vessel discharge valve 9. The inner wall of the vessel 1 was visually inspected after the liquid B had been discharged: the scale deposits on the inner wall of the vessel 1 had not been completely removed, and the glass lining layer in the interior of the vessel 1 was seen to be exposed at merely some locations.

After the completion of 20 batches of the process up to this point using the vessel 1, the interior of the vessel was visually inspected: scale deposition was worse than after washing with the liquid B and discharging thereof at the first batch. In addition, a glass lining-treated area was visually inspected after the deposits had been removed with a scraper: due to the alkali treatment the surface had undergone a light erosion by dissolution, and scale had grown as far as in the glass lining layer.

The scale increment was determined from the times taken to raise the temperature from 70° C. to 80° C. for the first and twentieth batches. The properties of toner particle 19 for the first and twentieth batches and the scale increment are given in Table 2.

Comparative Example 7

Toner particle 20 was produced by carrying out the same procedures as in Example 3 with the exception of the washing with the liquid B.

(Washing with Liquid B)

After the slurry had been discharged, the interior of the vessel 1 of FIG. 1 was thoroughly washed with ion-exchanged water. After the washing, the inner wall of the vessel 1 was visually inspected, and it was noted that faint scale deposits had been produced on the inner wall of the vessel 1. After the washing, sodium hydroxide was added to 600 kg of ion-exchanged water and the liquid temperature was heated to 98° C., and, while stirring at 80 rpm with the stirring blade 2, the concentration was adjusted to give a pH of 12.0, thus producing the liquid B. Then, while continuing to stir at 98° C./80 rpm, the calcium phosphate adhered to the inner wall of the vessel 1 was dissolved. After 30 minutes the stirring was stopped and the liquid B was discharged from the vessel 1 through the vessel discharge valve 9. The inner wall of the vessel 1 was visually inspected after the liquid B had been discharged: the scale deposits on the inner wall of the vessel 1 had not been completely removed, and the glass lining layer in the interior of the vessel 1 was seen to be exposed at merely some locations.

After the completion of 20 batches of the process up to this point using the vessel 1, the interior of the vessel was visually inspected: scale deposition was worse than after washing with the liquid B and discharging thereof at the first batch. In addition, a glass lining-treated area was visually inspected after the deposits had been removed with a scraper: due to the alkali treatment the surface had obviously undergone erosion by dissolution, and scale had grown as far as in the glass lining layer.

The scale increment was determined from the times taken to raise the temperature from 70° C. to 80° C. for the first and twentieth batches. The properties of toner particle 20 for the first and twentieth batches and the scale increment are given in Table 2.

TABLE 1

| | inorganic dispersion stabilizer in the aqueous medium | inorganic dispersion stabilizer in liquid A | prep-aration of liquid A | use amount for liquid A (kg) | discharge of liquid A | circulation application of liquid A | pH of liquid B | tem-perature of liquid B (° C.) | circulation washing with liquid B | use amount for liquid B (kg) | material of the polymerization vessel | A* |
|---|---|---|---|---|---|---|---|---|---|---|---|---|
| example 1 | calcium phosphate | calcium phosphate | 1 | 100 | 1 | Y | 2.0 | 20 | Y | 100 | GL | 1 |
| example 2 | calcium phosphate | calcium phosphate | 2 | 100 | 1 | Y | 2.0 | 20 | Y | 100 | GL | 1 |
| example 3 | calcium phosphate | calcium phosphate | 1 | 600 | 2 | N | 2.0 | 20 | N | 600 | GL | 1 |
| example 4 | calcium phosphate | calcium phosphate | 2 | 600 | 2 | N | 2.0 | 20 | N | 600 | GL | 1 |
| example 5 | calcium phosphate | calcium phosphate | 2 | 600 | 2 | N | 3.0 | 20 | N | 600 | GL | 1 |
| example 6 | calcium phosphate | calcium phosphate | 2 | 600 | 2 | N | 4.2 | 20 | N | 600 | GL | 1 |
| example 7 | calcium phosphate | magnesium hydroxide | 2 | 600 | 2 | N | 4.5 | 20 | N | 600 | GL | 1 |
| example 8 | calcium phosphate | magnesium hydroxide | 2 | 600 | 2 | N | 5.5 | 20 | N | 600 | GL | 1 |
| example 9 | calcium phosphate | magnesium hydroxide | 2 | 600 | 2 | N | 6.0 | 20 | N | 600 | GL | 1 |
| example 10 | calcium phosphate | calcium phosphate | 2 | 600 | 2 | N | 2.0 | 20 | N | 600 | GL | 1 |
| example 11 | calcium phosphate | calcium phosphate | 2 | 600 | 2 | N | 3.0 | 20 | N | 600 | GL | 1 |
| example 12 | calcium phosphate | calcium phosphate | 2 | 600 | 2 | N | 4.2 | 20 | N | 600 | GL | 1 |
| example 13 | calcium phosphate | calcium phosphate | 2 | 600 | 2 | N | 3.0 | 98 | N | 600 | GL | 1 |
| comparative example 1 | calcium phosphate | calcium phosphate | 2 | 600 | 2 | N | — | — | N | — | GL | 1 |
| comparative example 2 | calcium phosphate | magnesium hydroxide | 2 | 600 | 2 | N | — | — | N | — | GL | 1 |
| comparative example 3 | calcium phosphate | calcium phosphate | 2 | 600 | 2 | N | — | — | N | — | GL | 1 |
| comparative example 4 | calcium phosphate | calcium phosphate | 2 | 600 | 2 | N | 10.0 | 20 | N | 600 | GL | 1 |
| comparative example 5 | calcium phosphate | calcium phosphate | 2 | 600 | 2 | N | 12.0 | 20 | N | 600 | GL | 1 |
| comparative example 6 | calcium phosphate | calcium phosphate | 2 | 600 | 2 | N | 10.0 | 98 | N | 600 | GL | 2 |

TABLE 1-continued

| | inorganic dispersion stabilizer in the aqueous medium | inorganic dispersion stabilizer in liquid A | prep-aration of liquid A | use amount for liquid A (kg) | discharge of liquid A | circulation application of liquid A | pH of liquid B | tem-perature of liquid B (° C.) | circulation washing with liquid B | use amount for liquid B (kg) | material of the polymerization vessel | A* |
|---|---|---|---|---|---|---|---|---|---|---|---|---|
| comparative example 7 | calcium phosphate | calcium phosphate | 2 | 600 | 2 | N | 12.0 | 98 | N | 600 | GL | 3 |

preparation of liquid A <1; produced within the vessel, 2; adjustment of commercial product>
discharge of liquid A <1; not discharged, 2; discharged from vessel>
circulation application of liquid A <Y; circulation application is performed, N; circulation application not performed>
circulation washing with liquid B <Y; circulation washing is performed, N; circulation washing not performed>
material of the polymerization vessel <GL; glass lining>
A* condition of the vessel glass lining after 20 batches <1; no change, 2; some dissolution, 3; dissolution>

TABLE 2

| | D4 (1st batch) | D4 (20th batch) | coarse particle amount (1st batch) | coarse particle amount (20th batch) | heating time (minutes) for 1st batch: t1 | heating time (minutes) for 20th batch: t20 | scale increment (t20 − t1)/t1 × 100 (%) |
|---|---|---|---|---|---|---|---|
| example 1 | 6.49 | 6.51 | 0.29 | 0.32 | 30 | 30 | 0 |
| example 2 | 6.50 | 6.60 | 0.30 | 0.55 | 30 | 32 | 7 |
| example 3 | 6.49 | 6.53 | 0.29 | 0.36 | 30 | 30 | 0 |
| example 4 | 6.50 | 6.59 | 0.30 | 0.63 | 30 | 33 | 10 |
| example 5 | 6.49 | 6.66 | 0.30 | 0.89 | 30 | 35 | 17 |
| example 6 | 6.50 | 6.71 | 0.30 | 1.52 | 30 | 40 | 33 |
| example 7 | 6.50 | 6.61 | 0.30 | 0.71 | 30 | 33 | 10 |
| example 8 | 6.50 | 6.67 | 0.30 | 1.06 | 30 | 35 | 17 |
| example 9 | 6.50 | 6.73 | 0.30 | 1.58 | 30 | 41 | 37 |
| example 10 | 6.49 | 6.60 | 0.30 | 0.68 | 30 | 33 | 10 |
| example 11 | 6.50 | 6.68 | 0.30 | 0.95 | 30 | 36 | 20 |
| example 12 | 6.50 | 6.72 | 0.30 | 1.66 | 30 | 40 | 33 |
| example 13 | 6.50 | 6.68 | 0.30 | 0.91 | 30 | 35 | 17 |
| comparative example 1 | 6.50 | 6.83 | 0.30 | 3.09 | 30 | 62 | 107 |
| comparative example 2 | 6.50 | 6.87 | 0.30 | 3.36 | 30 | 65 | 117 |
| comparative example 3 | 6.50 | 6.85 | 0.30 | 3.17 | 30 | 63 | 110 |
| comparative example 4 | 6.50 | 6.85 | 0.30 | 3.15 | 30 | 65 | 117 |
| comparative example 5 | 6.50 | 6.85 | 0.30 | 3.13 | 30 | 64 | 113 |
| comparative example 6 | 6.50 | 6.85 | 0.30 | 3.05 | 30 | 60 | 100 |
| comparative example 7 | 6.50 | 6.85 | 0.30 | 3.02 | 30 | 55 | 83 |

The D4 in the table represents the weight-average particle diameter (D4) (μm) of the toner particles. The coarse particle amount represents the volume-based coarse particle amount (volume %) in the toner particles.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-271774, filed Dec. 27, 2013 which is hereby incorporated by reference herein in its entirety.

What is claimed is:

1. A method for producing toner particles comprising the steps of:

(1) providing an aqueous dispersion in which particles are dispersed in an aqueous medium, the particles containing (i) a polymerizable monomer and a colorant, or (ii) a mixed solution in which a toner particle composition comprising a binder resin and a colorant, and an organic solvent, are contained, the toner particle composition being dissolved or dispersed in the organic solvent, (2) introducing the aqueous dispersion into a vessel, and (3) obtaining the toner particles by (i) polymerizing the polymerizable monomer in the particles, or (ii) removing the organic solvent from the mixed solution in the particles, (4) removing a content in the vessel after the step (3), wherein, the method further comprises a step of applying an inorganic dispersion stabilizer containing liquid (liquid A) and attaching the inorganic dispersion stabilizer to a part of an inner wall of the vessel, prior to introducing the aqueous dispersion into the vessel in the step (2), the part of the inner wall of the vessel including a portion where the aqueous dispersion which is to be introduced in the step (2) is come into contact with, and a step of removing the inorganic dispersion stabilizer attached to the part of the inner wall of the vessel by using an acidic aqueous solution (liquid B) after the step (4).

2. The method for producing toner particles according to claim 1, wherein the inner wall of the vessel has been subjected to a glass lining treatment.

3. The method for producing toner particles according to claim 1, wherein the inorganic dispersion stabilizer in the liquid A is a sparingly water-soluble metal phosphate.

4. The method for producing toner particles according to claim 3, wherein pH of the liquid B is not more than 3.0.

5. The method for producing toner particles according to claim 1, wherein the inorganic dispersion stabilizer in the liquid A is a sparingly water-soluble metal hydroxide.

6. The method for producing toner particles according to claim 5, wherein pH of the liquid B is not more than 5.5.

7. The method for producing toner particles according to claim 1, wherein the vessel is provided with a circulation line that discharges the liquid A or the liquid B from a bottom part of the vessel and re-introduces the same into the interior of the vessel from a top part of the vessel.

8. The method for producing toner particles according to claim 1, wherein the liquid A is prepared in the interior of the vessel.

* * * * *